US008122536B2

(12) United States Patent
Peixin et al.

(10) Patent No.: US 8,122,536 B2
(45) Date of Patent: Feb. 28, 2012

(54) BED WITH COLLAPSIBLE FRAME

(75) Inventors: Zhu Peixin, Fujian (CN); Lee Pil Yul, Seoul (KR)

(73) Assignee: North Pole US LLC, Washington, MO (US)

( * ) Notice: Subject to any disclaimer, the term of this patent is extended or adjusted under 35 U.S.C. 154(b) by 655 days.

(21) Appl. No.: 11/712,762

(22) Filed: Feb. 28, 2007

(65) Prior Publication Data

US 2008/0000024 A1 Jan. 3, 2008

(30) Foreign Application Priority Data

Jun. 28, 2006 (CN) ..... 2006 2 0086530 U

(51) Int. Cl.
*A47C 19/12* (2006.01)

(52) U.S. Cl. ..... 5/174; 5/181; 5/112; 5/114; 5/110

(58) Field of Classification Search ..... 5/114, 116, 5/111, 115, 175, 176.1, 177, 181–185, 411, 5/706

See application file for complete search history.

(56) References Cited

U.S. PATENT DOCUMENTS

| | | | | |
|---|---|---|---|---|
| 630,140 | A * | 8/1899 | Varcoe | 5/182 |
| 779,622 | A * | 1/1905 | Pieper | 5/175 |
| 3,967,330 | A | 7/1976 | Zawadowsky | |
| 4,384,379 | A | 5/1983 | Yamada | |
| 4,594,743 | A * | 6/1986 | Owen et al. | 5/111 |
| 4,679,261 | A * | 7/1987 | Stanley et al. | 5/183 |
| D411,387 | S | 6/1999 | Zheng | |
| 6,134,727 | A | 10/2000 | Hwang | |
| 6,457,192 | B2 | 10/2002 | Choi et al. | |
| 6,564,402 | B1 | 5/2003 | Lin | |
| 6,581,223 | B1 | 6/2003 | Wang | |
| 6,711,761 | B2 | 3/2004 | Choi | |
| 6,763,534 | B2 | 7/2004 | Hwang | |
| 6,966,084 | B2 | 11/2005 | Le Gette et al. | |
| 7,114,205 | B2 | 10/2006 | Choi | |
| 7,406,726 | B2 * | 8/2008 | Deng | 5/127 |
| 2006/0000020 | A1 * | 1/2006 | Matheus et al. | 5/110 |
| 2008/0216230 | A1 * | 9/2008 | Yul et al. | 5/12.2 |

OTHER PUBLICATIONS

International Search Report for corresponding PCT patent application No. PCT/US2007/071764 filed Jun. 21, 2007 (2 pages).

* cited by examiner

*Primary Examiner* — Robert G Santos
*Assistant Examiner* — Brittany Wilson
(74) *Attorney, Agent, or Firm* — Armstrong Teasdale LLP

(57) ABSTRACT

A frame including a plurality of connector assemblies and a cross-support unit coupled between the plurality of connector assemblies. The cross-support unit is movable between a folded configuration and an expanded configuration. The cross-support unit defines a substantially planar support structure in the expanded configuration.

38 Claims, 18 Drawing Sheets

BED WITH COLLAPSIBLE FRAME

CROSS REFERENCE TO RELATED APPLICATIONS

This application claims the benefit of Chinese Patent Application 200620086530.3 entitled "A Bed with Improved Support Structure and An Improved Collapsible Support Base," filed on Jun. 28, 2006, which is hereby incorporated by reference in its entirety.

BACKGROUND OF THE INVENTION

This invention relates generally to foldable and/or collapsible furniture and, more particularly, to a bed having a collapsible frame or base.

Conventional collapsible beds may include an air mattress that is supported by a collapsible frame. At least one such frame includes a plurality of uprights, which are joined by pivot assemblies such that the support frame as a whole expands outwardly from a central area when a portion of the frame is pulled outwardly. With the frame expanded, the uprights support an air mattress positioned on the uprights.

BRIEF DESCRIPTION OF THE INVENTION

In one aspect, a frame is provided. The frame includes a plurality of connector assemblies and a cross-support unit coupled between the plurality of connector assemblies. The cross-support unit is movable between a folded configuration and an expanded configuration. The cross-support unit defines a substantially planar support structure in the expanded configuration.

In another aspect, a frame is provided. The frame includes a plurality of first connector assemblies and a plurality of second connector assemblies. A cross-support unit is coupled between the plurality of first connector assemblies and the plurality of second connector assemblies. The cross-support unit is movable between a folded configuration and an expanded configuration. The cross-support unit defines a substantially planar support structure in the expanded configuration.

In another aspect, a frame is provided. The frame includes a plurality of connector assemblies. A cross-support unit is coupled between the plurality of connector assemblies and is movable between a folded configuration and an expanded configuration. An extendible support member is coupled between a first connector assembly of the plurality of connector assemblies and a laterally aligned second connector assembly of the plurality of connector assemblies. The extendible support member is movable between a retracted configuration and an extended configuration.

In another aspect, a frame is provided. The frame includes a first connector assembly having a first portion and a second portion movably coupled to the first portion to facilitate moving the frame between a collapsed configuration and an expanded configuration. A second connector assembly is laterally aligned with the first connector assembly. A cross-support unit is coupled between the first connector assembly and the second connector assembly.

In another aspect, a frame is provided. The frame includes a plurality of first connector assemblies and a plurality of second connector assemblies. Each second connector assembly of the plurality of second connector assemblies is laterally aligned with a corresponding first connector assembly of the plurality of first connector assemblies. Each of a plurality of first upright members is pivotally coupled to a corresponding first connector assembly and each of a plurality of second upright members is pivotally coupled to a corresponding second connector assembly.

In another aspect, a frame is provided. The frame includes a plurality of first connector assemblies positioned along a longitudinal axis of the frame and a plurality of second connector assemblies. A first cross-support unit is coupled between the plurality of first connector assemblies and the plurality of second connector assemblies. The first cross-support unit is movable between a folded configuration and an expanded configuration such that at least one first connector assembly of the plurality of first connector assemblies moves along the longitudinal axis. The first cross-support unit defines a substantially planar support structure in the expanded configuration.

In another aspect, a bed is provided. The bed includes a frame including a plurality of connector assemblies and a cross-support unit coupled between the plurality of connector assemblies. The cross-support unit is movable between a folded configuration and an expanded configuration. The cross-support unit defines a substantially planar support structure in the expanded configuration. A mattress is supported by the frame.

In another aspect, a bed is provided. The bed includes a collapsible frame including a plurality of first connector assemblies and a plurality of second connector assemblies. A cross-support unit is coupled between the plurality of first connector assemblies and the plurality of second connector assemblies. The cross-support unit is movable between a folded configuration and an expanded configuration. The cross-support unit defines a substantially planar support structure in the expanded configuration. A mattress is coupled to the collapsible frame.

In another aspect, a method for constructing a bed having a collapsible frame is provided. The method includes providing a frame including a plurality of connector assemblies and a cross-support unit coupled between the plurality of connector assemblies. The cross-support unit is moved between a folded configuration and an expanded configuration to define a substantially planar support structure in the expanded configuration.

In another aspect, a method is provided for constructing a bed having a collapsible frame. The method includes providing a frame including a plurality of first connector assemblies, a plurality of second connector assemblies, and a cross-support unit coupled between the plurality of first connector assemblies and the plurality of second connector assemblies such that the plurality of first connector assemblies move along a longitudinal axis of the frame as the cross-support unit moves from a folded configuration to an expanded configuration. The cross-support unit is moved between the folded configuration and the expanded configuration to define a substantially planar support structure in the expanded configuration.

DETAILED DESCRIPTION OF THE INVENTION

The present invention provides a collapsible frame for a bed that forms a substantially planar support structure in an expanded configuration suitable for supporting a mattress, such as an air mattress. The bed is configured in a collapsed position for easy storage and/or transport. For example, in the collapsed configuration, the bed may be contained within a storage bag. When a sleeping area is desired, the frame is movable from the collapsed configuration to an intermediary folded configuration. The substantially planar support structure is then formed by moving the frame from the folded configuration to the extended configuration. A mattress is positioned on and support by the frame in the expanded configuration. In one embodiment, the mattress is removably coupled to the frame in the expanded configuration.

The present invention is described below in reference to its application in connection with and operation of a bed having a collapsible frame. However, it should be apparent to those skilled in the art and guided by the teachings herein provided that the invention is likewise applicable to any suitable foldable and/or collapsible furniture piece.

Referring to FIGS. 1-20, a bed 100 (shown in the FIGS. 8-10) includes a collapsible frame 10 and a mattress 12, such as an air mattress. In one embodiment, frame 10 includes a plurality of connector assemblies and a cross-support unit coupled between the connector assemblies. The cross-support unit is movable between a folded configuration and an expanded configuration to define a substantially planar support structure for supporting mattress 12. As frame 10 is moved between the folded configuration and the expanded configuration, a plurality of first connector assemblies move along or parallel with a longitudinal axis of the bed. Frame 10 is also movable from the folded configuration to a collapsed configuration to facilitate storing and/or transporting the bed.

Figure 1:
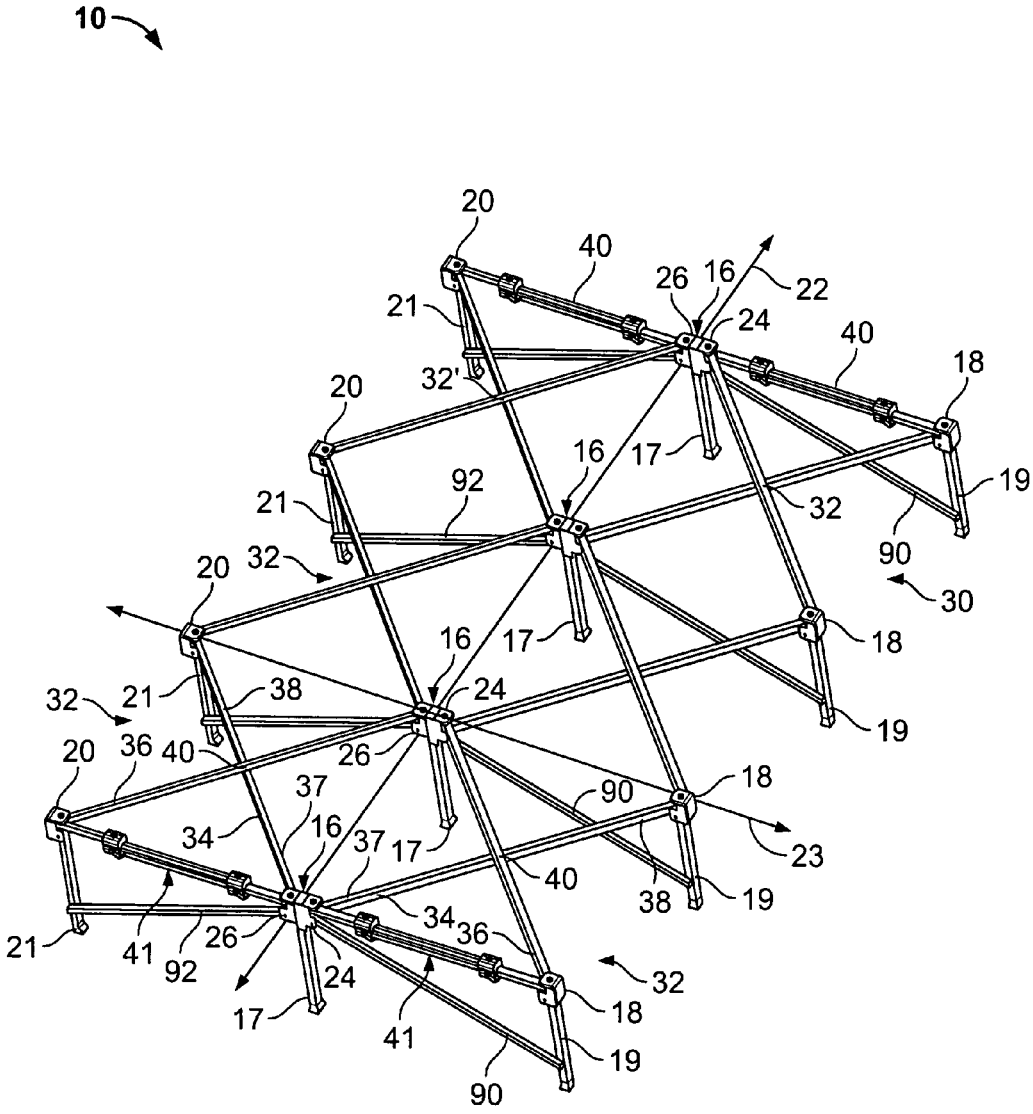
FIG. 1 is a perspective view of an exemplary collapsible frame in an expanded configuration.
Figure 2:
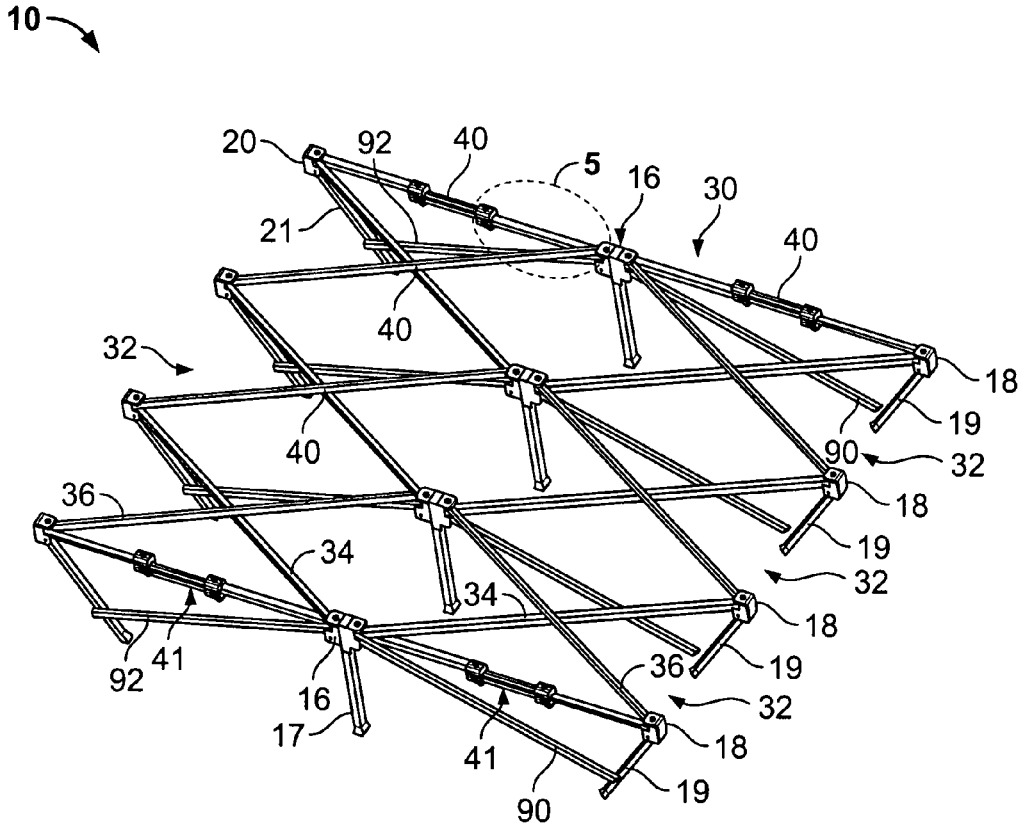
FIG. 2 is a perspective view of the collapsible frame shown in FIG. 1 in a partially folded configuration.
Figure 3:
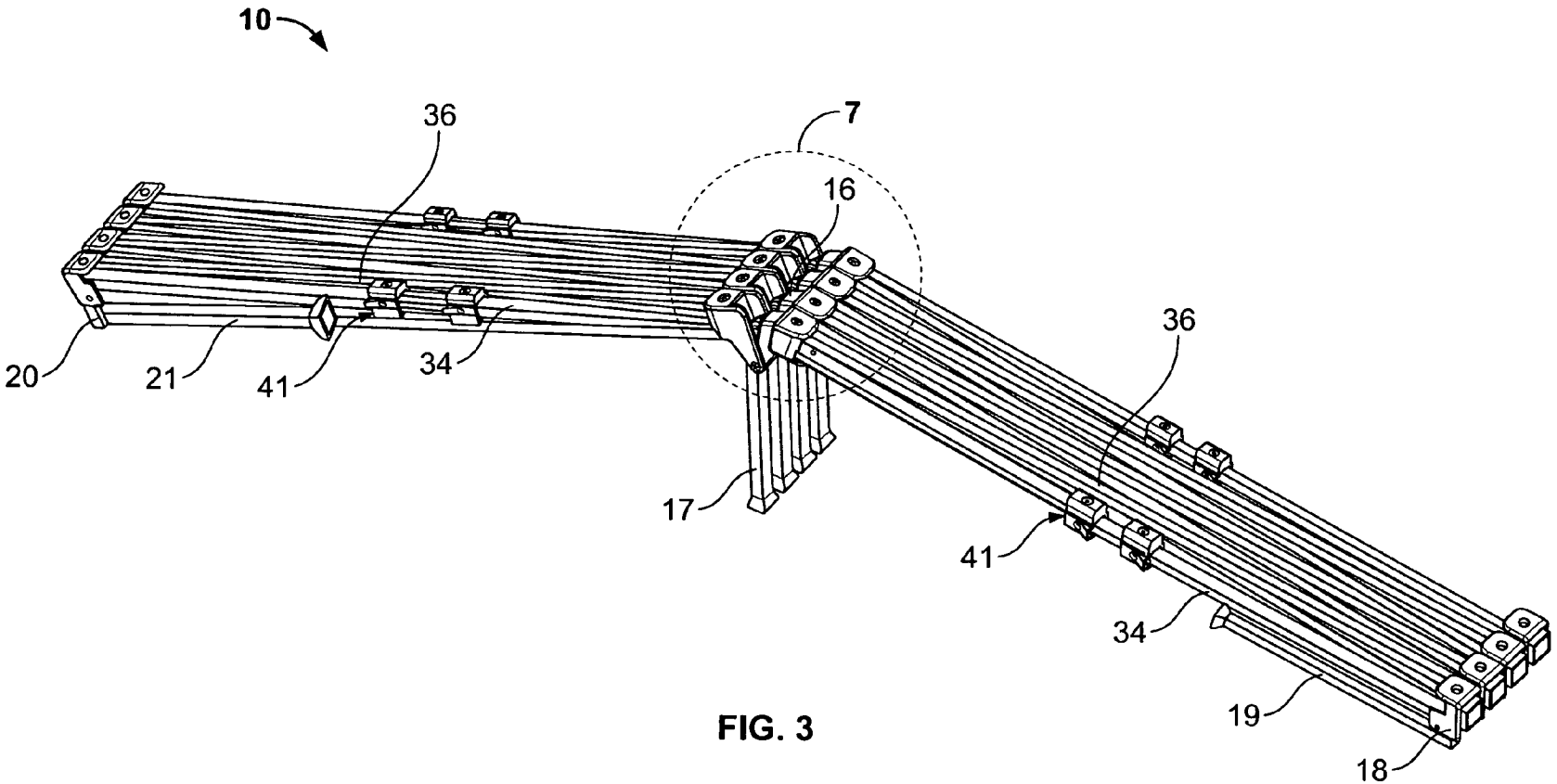
FIG. 3 is a perspective view of the collapsible frame shown in FIG. 1 in a folded configuration.
Figure 5:
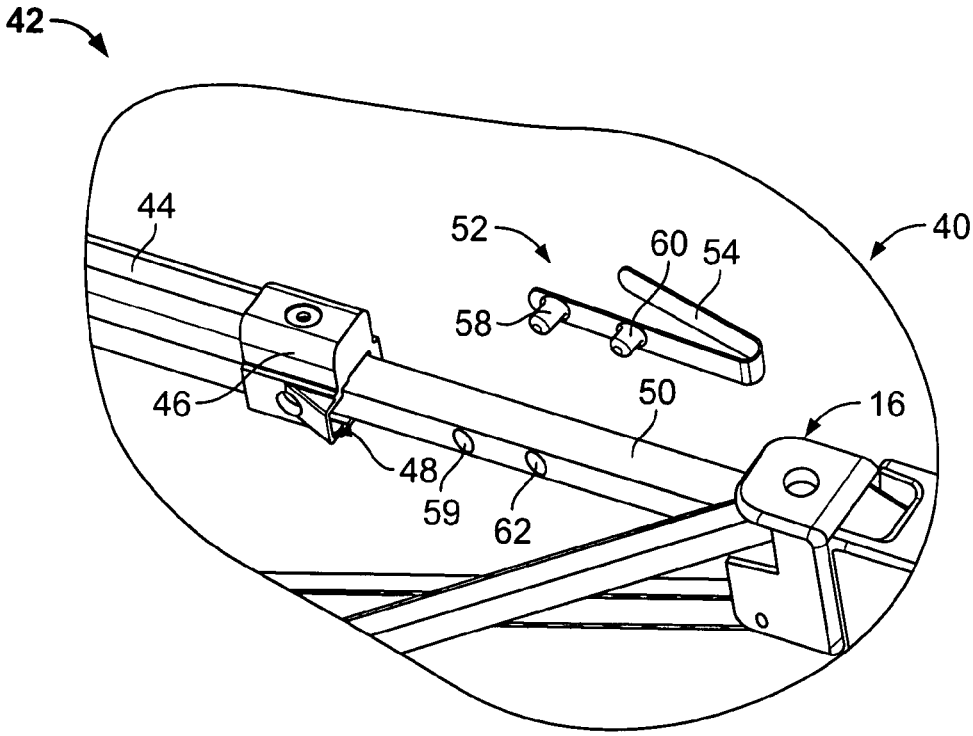
FIG. 5 is an enlarged view of a portion of the collapsible frame shown in FIG. 2.
Figure 6:
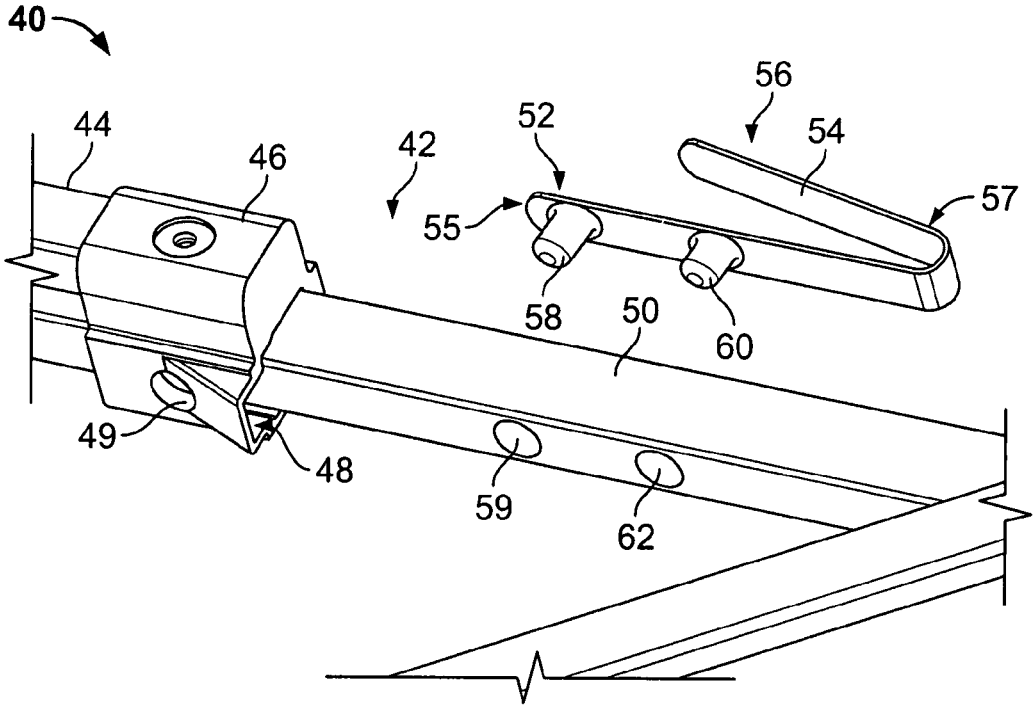
FIG. 6 is an enlarged view of a portion of the locking device shown in FIG. 5.
Figure 7:
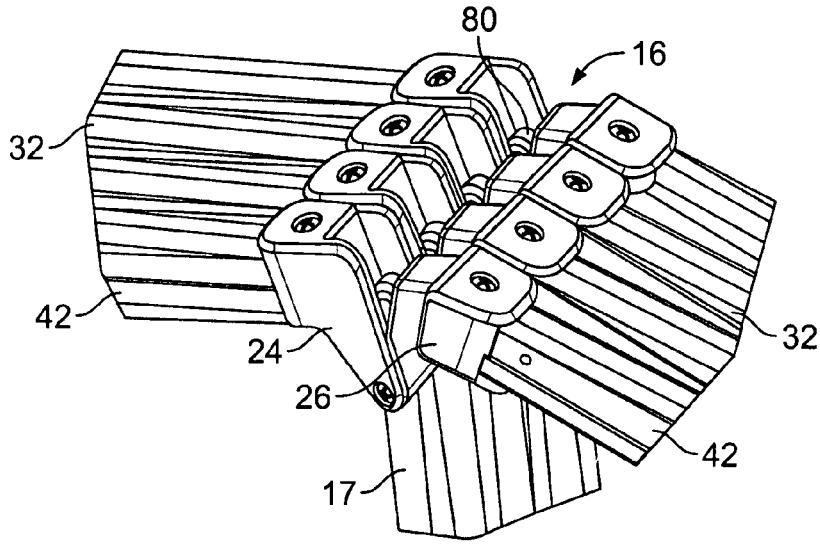
FIG. 7 is an enlarged view of a portion of the collapsible frame shown in FIG. 3.
Figure 8:
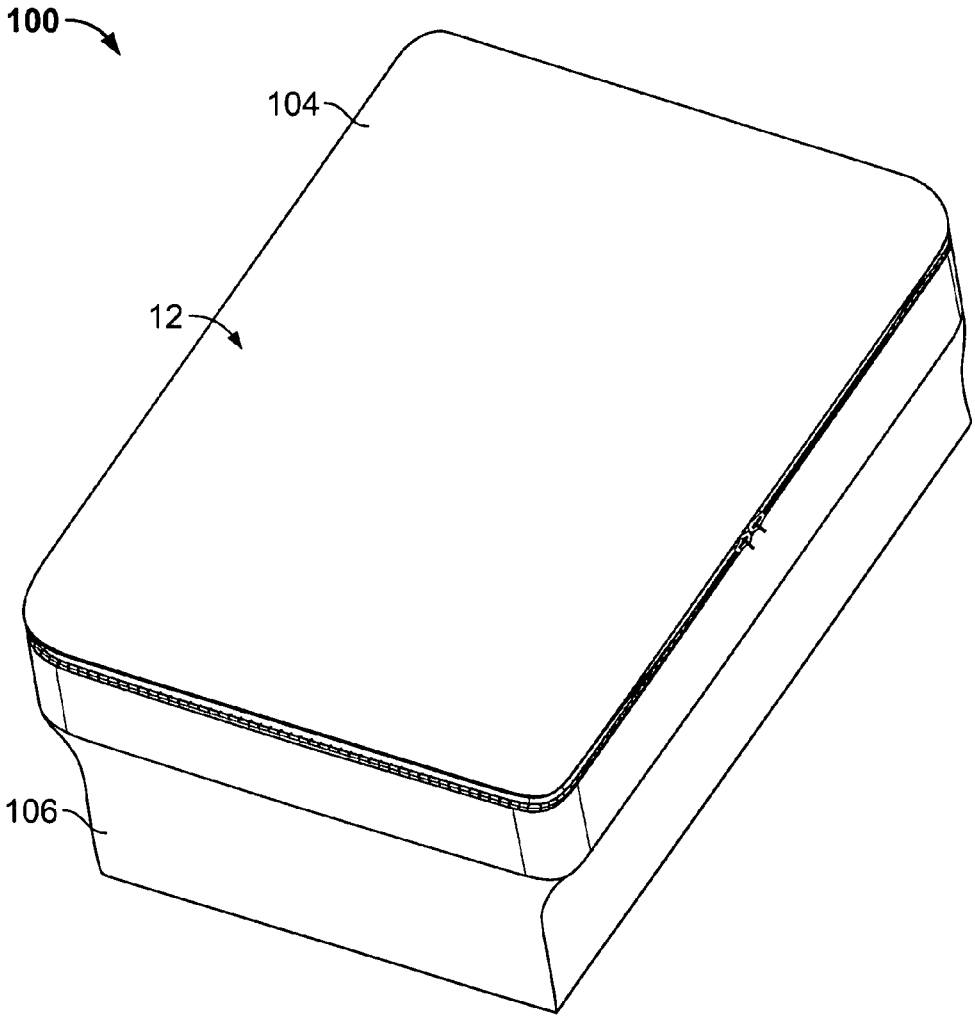
FIG. 8 is a perspective view of a bed with the collapsible frame in the expanded configuration and supporting a mattress.
Figure 9:
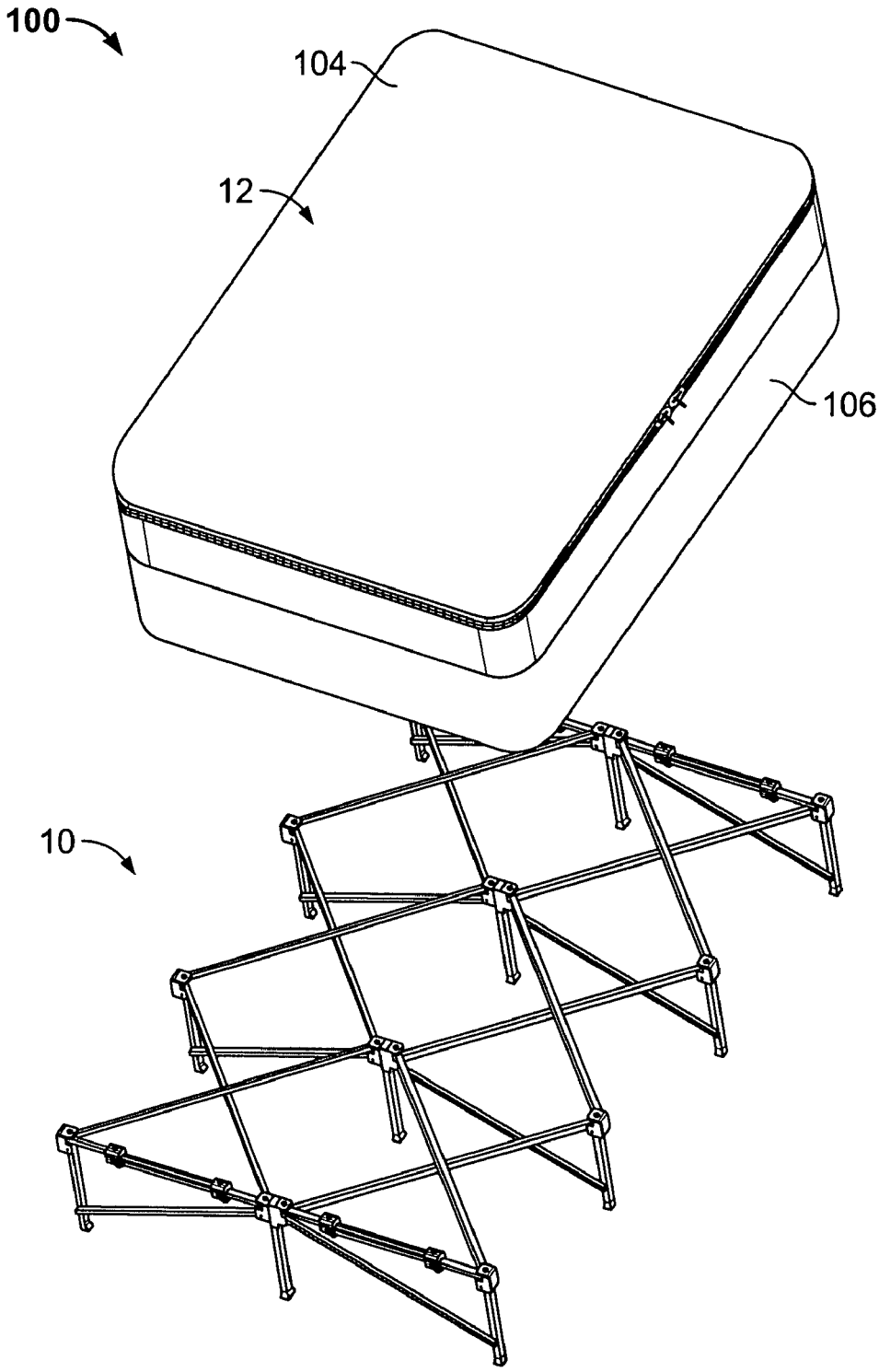
FIG. 9 is an exploded perspective view of the bed shown in FIG. 8.
Figure 10:
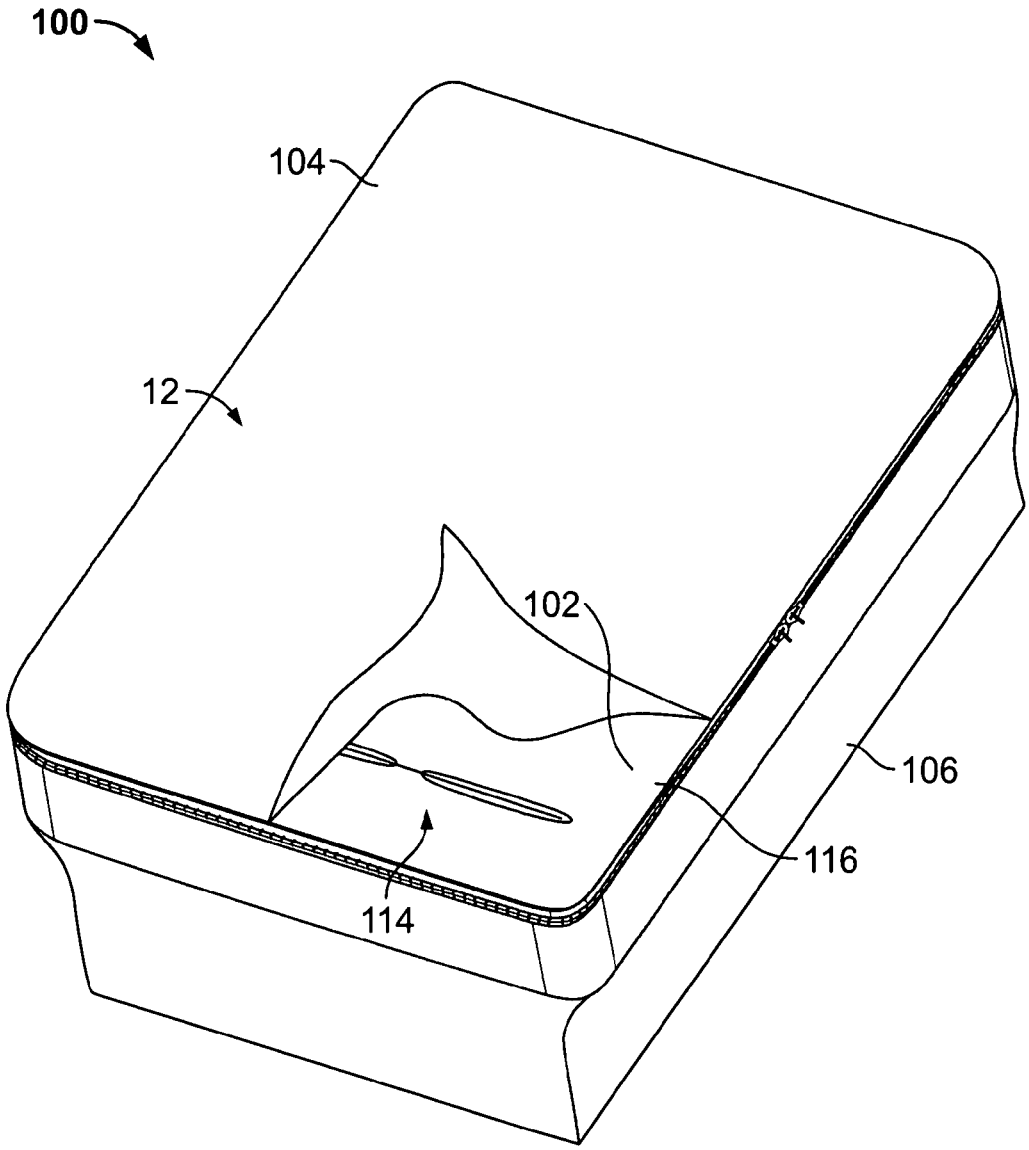
FIG. 10 is a perspective view of the bed shown in FIG. 8 with a portion of an outer liner removed to show an air mattress assembly.
Figure 11:
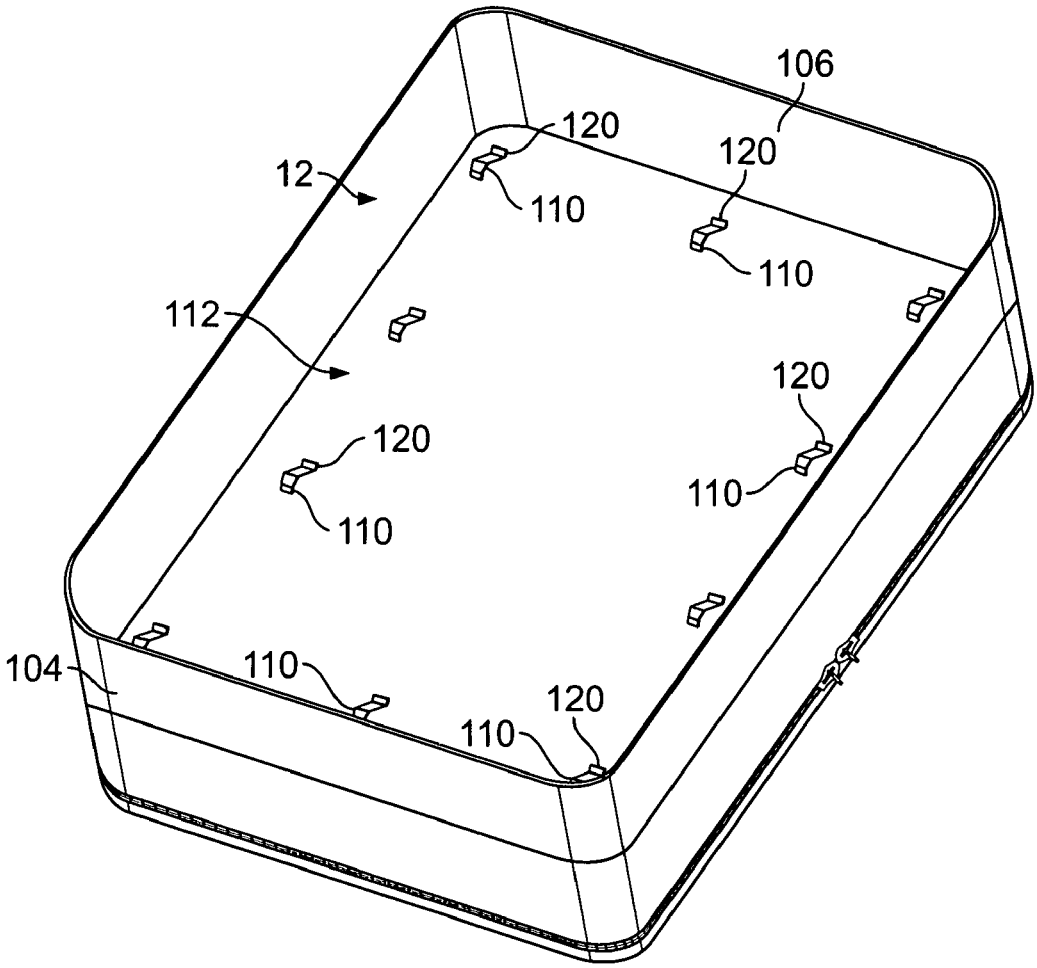
FIG. 11 is a perspective view of a bottom surface of the air mattress assembly.
Figure 12:
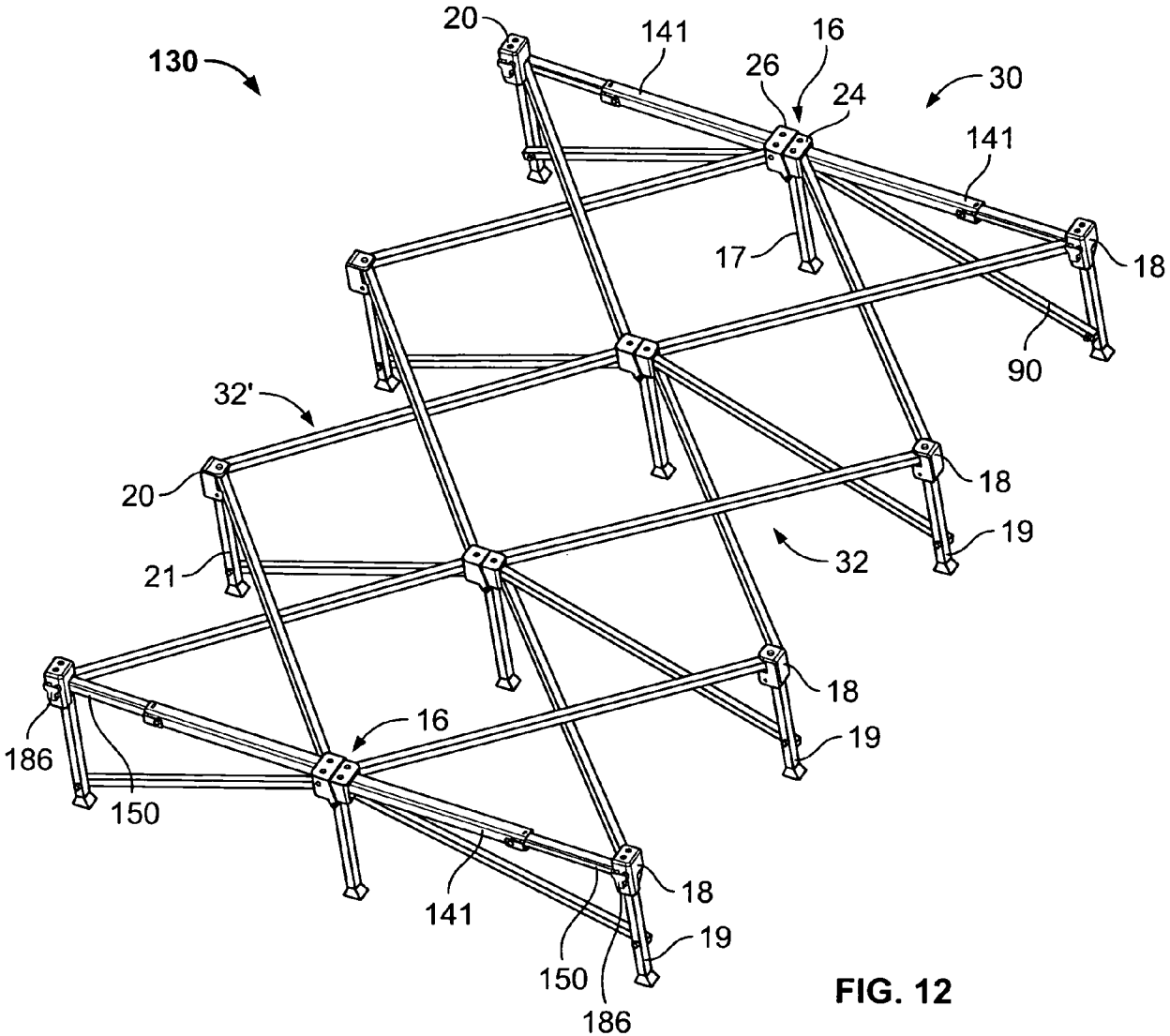
FIG. 12 is a perspective view of an alternative exemplary collapsible frame in an expanded configuration.
Figure 13:
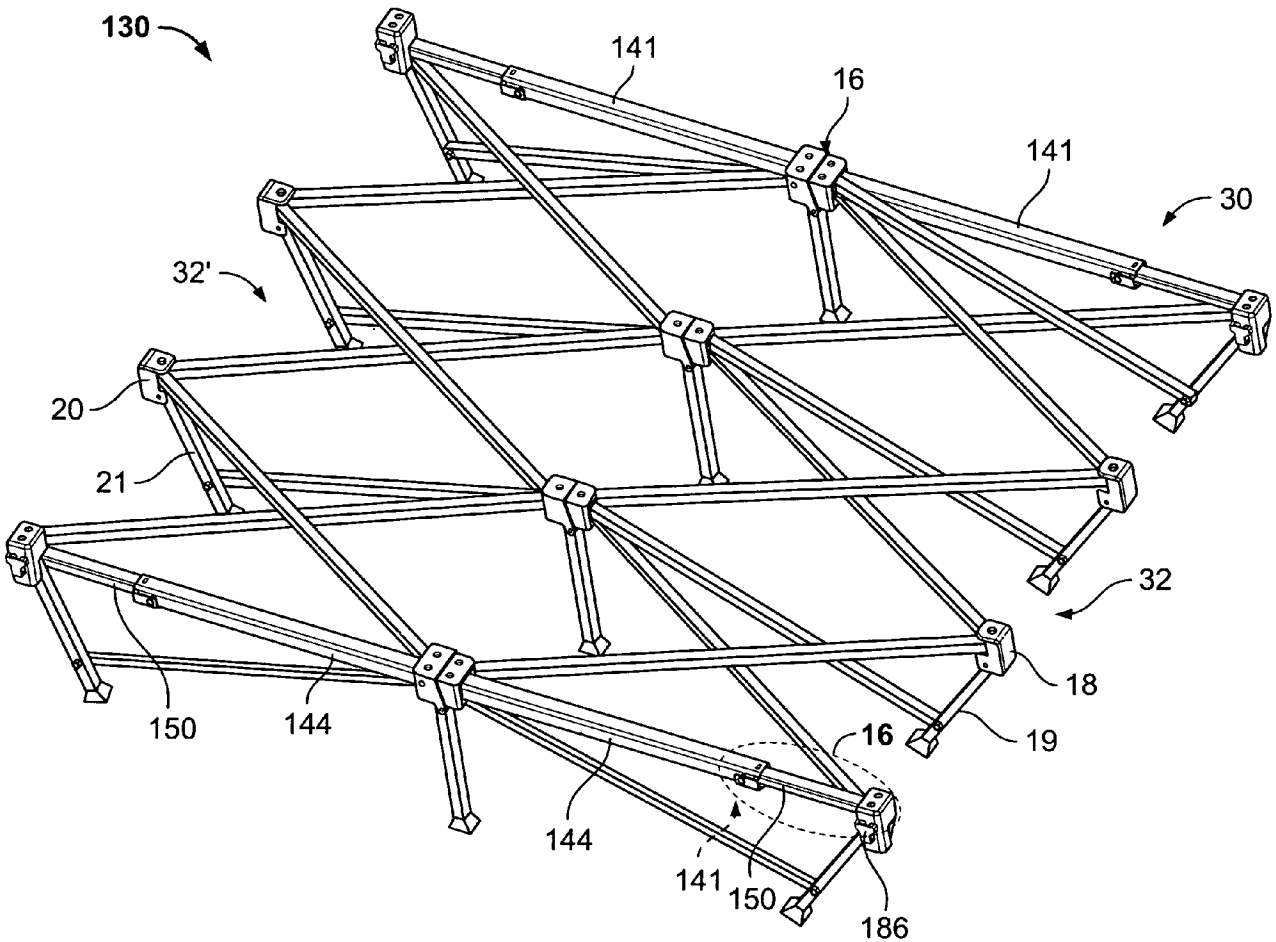
FIG. 13 is a perspective view of the collapsible frame shown in FIG. 12 in a partially folded configuration.
Figure 14:
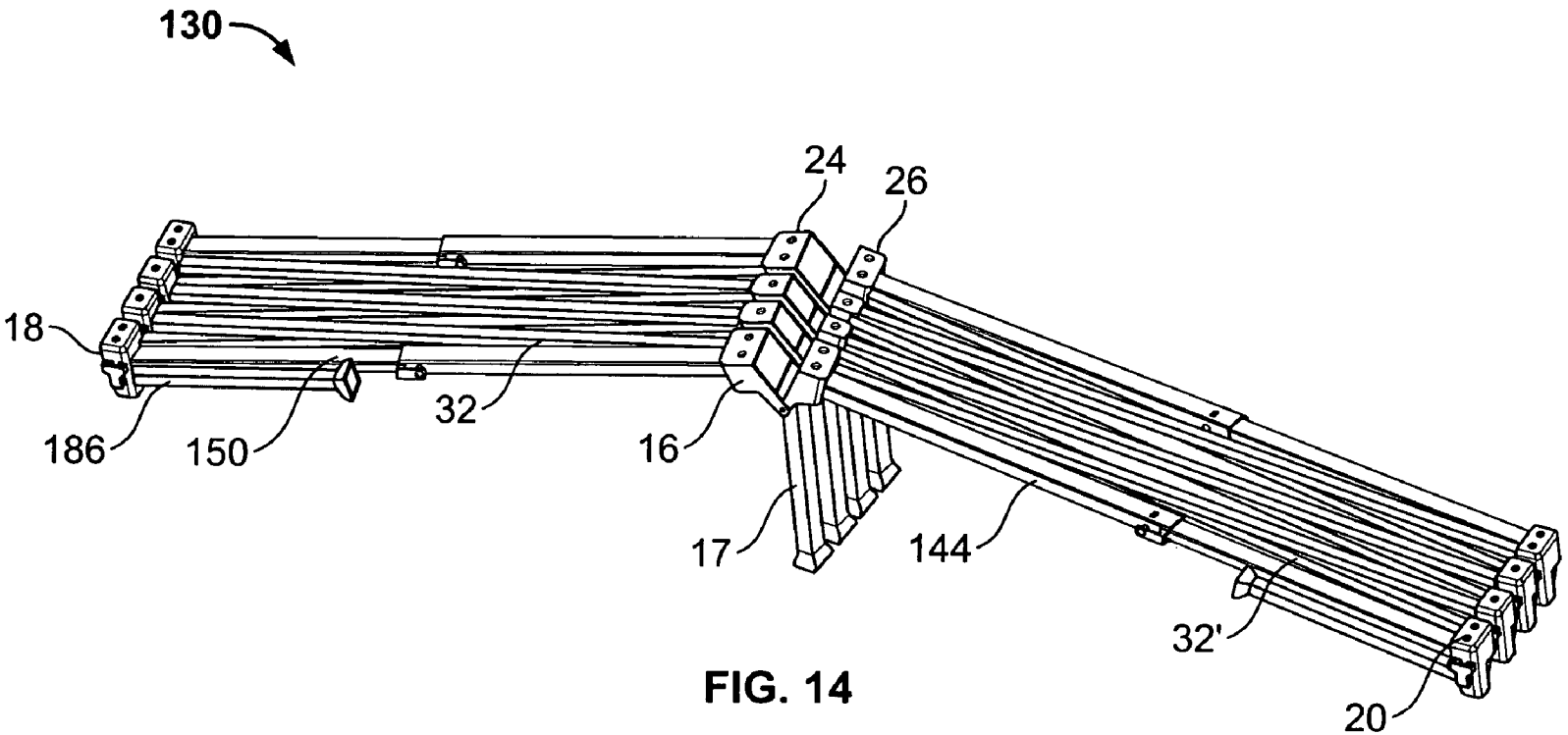
FIG. 14 is a perspective view of the collapsible frame shown in FIG. 12 in a folded configuration.
Figure 15:
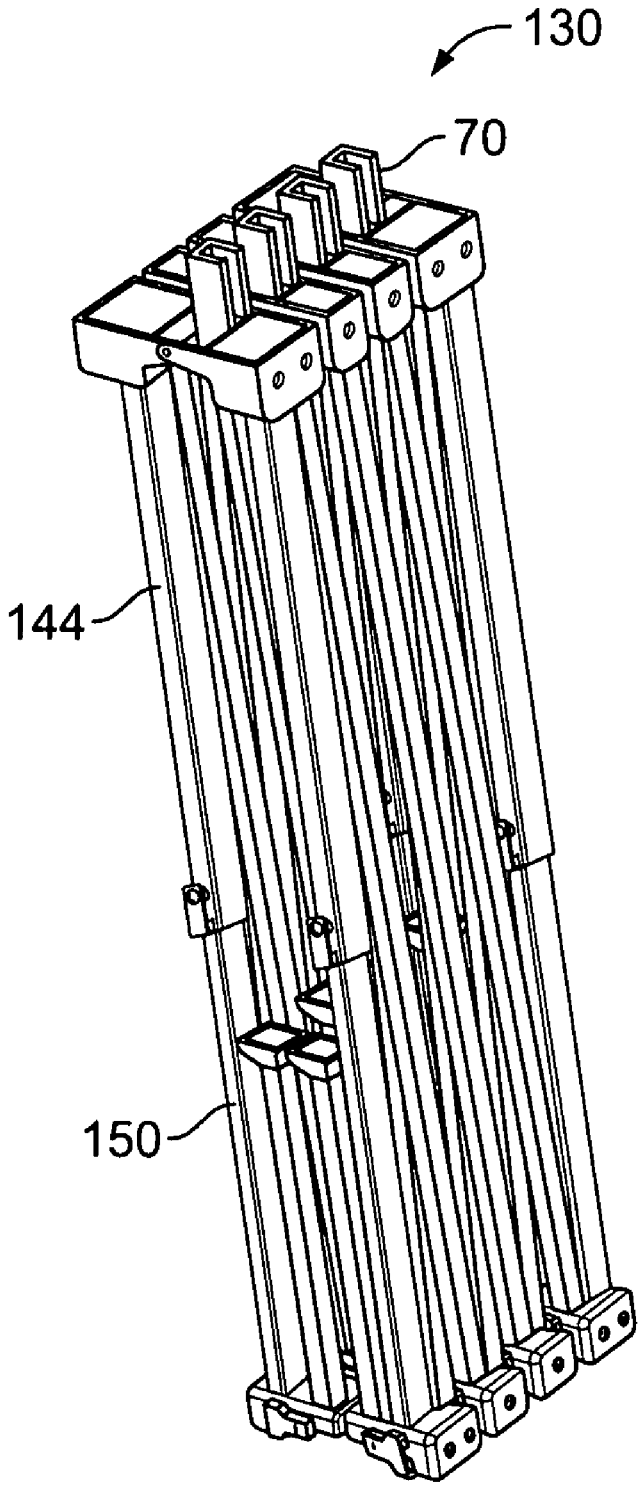
FIG. 15 is a perspective view of the collapsible frame shown in FIG. 12 in a collapsed configuration.
Figure 16:
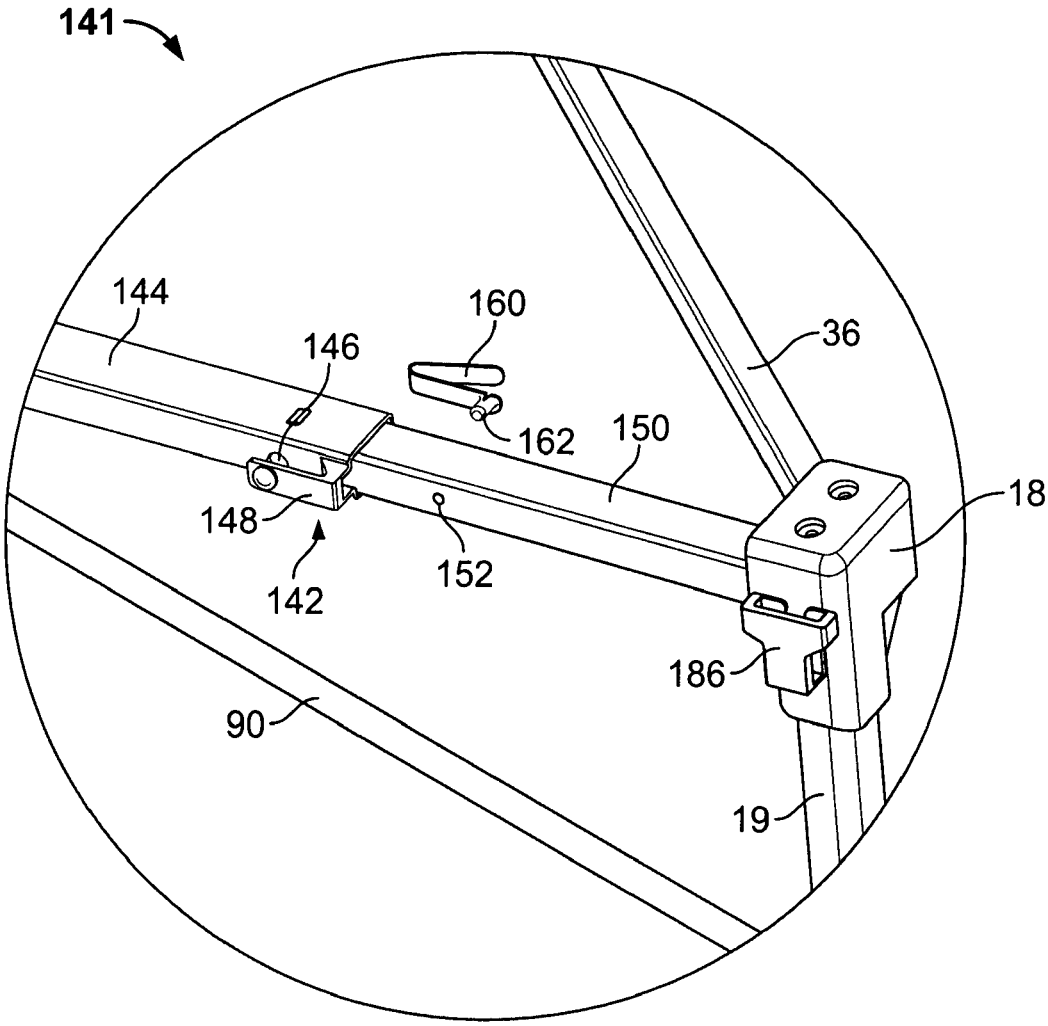
FIG. 16 is an enlarged view of a portion of the collapsible frame shown in FIG. 12.
Figure 17:
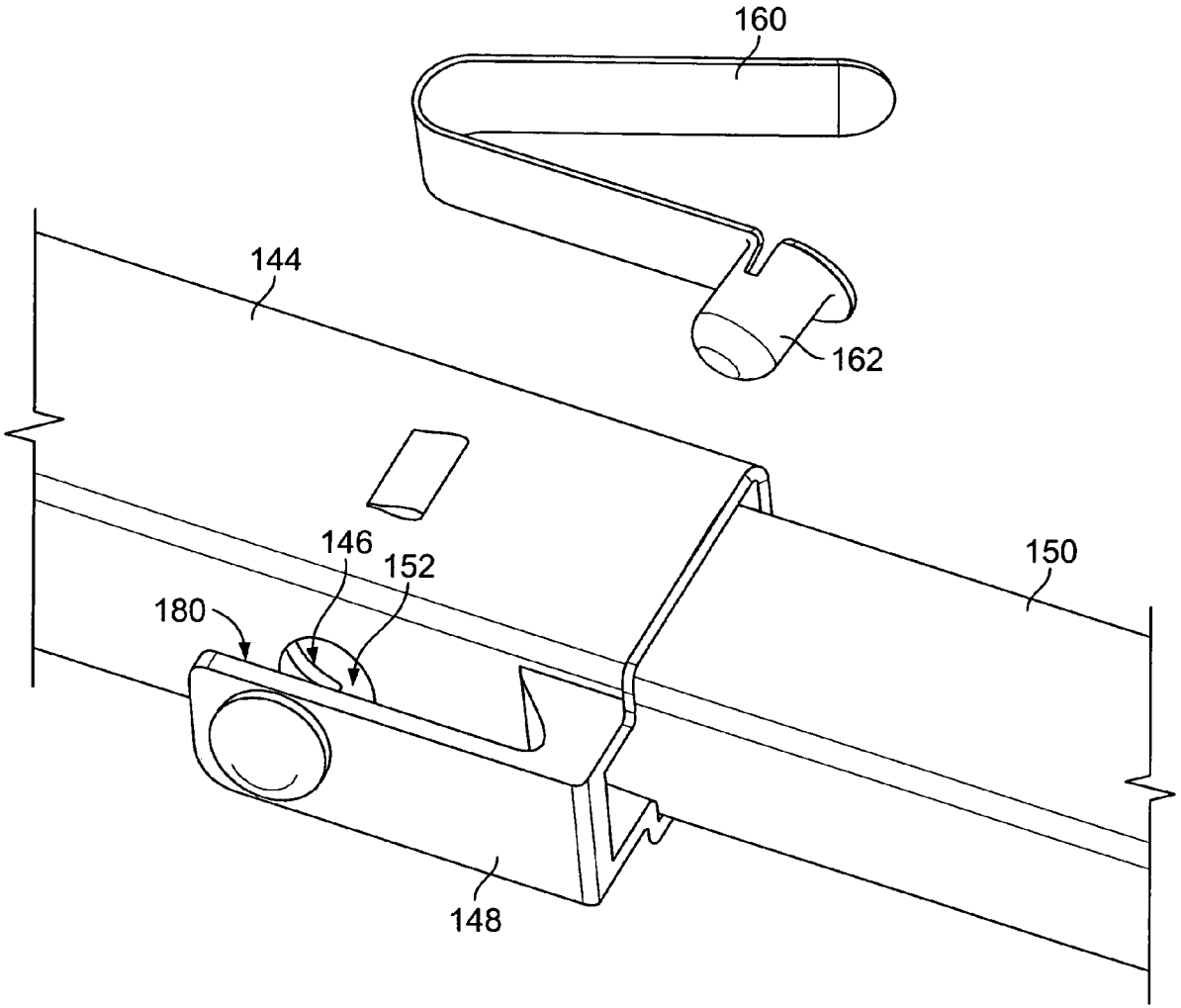
FIG. 17 is an enlarged, exploded view of a portion of the locking device shown in FIG. 16.
Figure 18:
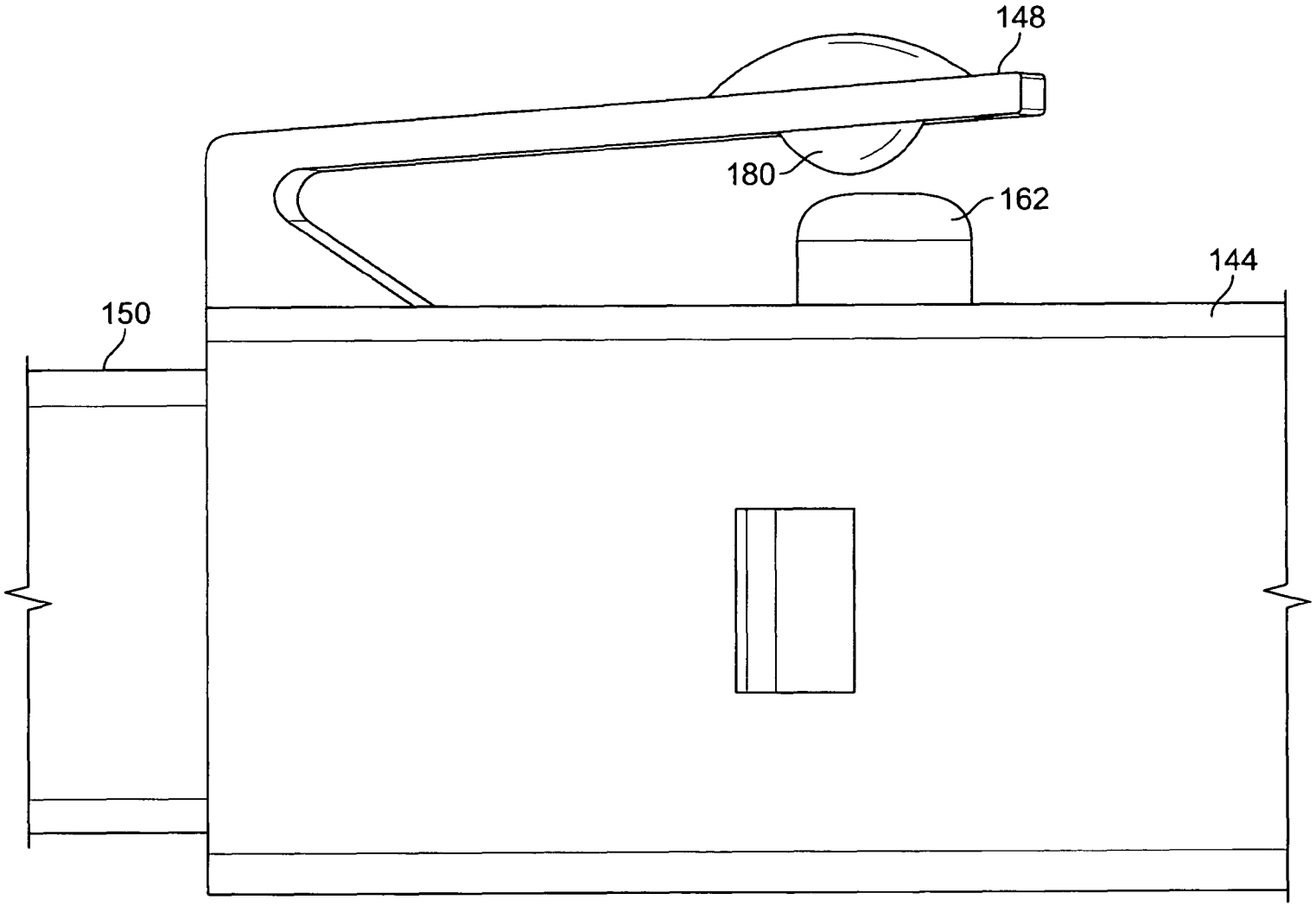
FIG. 18 is an enlarged view of a portion of the locking device shown in FIG. 16.

Referring further to FIGS. 1-11, collapsible frame 10 includes a plurality of connector assemblies coupled to a corresponding upright member. In one embodiment, collapsible frame 10 includes a plurality of first or middle connector assemblies 16 pivotally coupled to a corresponding first upright member 17, a plurality of second lateral edge connector assemblies 18 pivotally coupled to a corresponding second upright member 19, and a plurality of third or lateral edge connector assemblies 20 pivotally coupled to a corresponding third upright member 21. In one embodiment, first connector assemblies 16 are aligned along a longitudinal axis 22 of collapsible frame 10 and movable along longitudinal axis 22 to facilitate moving collapsible frame 10 between an extended position, such as shown in FIG. 1, and a folded position, such as shown in FIG. 3. Further, as shown in FIG. 1, each first connector assembly 16 is laterally aligned with a corresponding second connector assembly 18 and a corresponding third connector assembly 20 along or parallel with a lateral axis 23 substantially perpendicular to longitudinal axis 22. In one embodiment, each first connector assembly 16 includes a first portion 24 and a second portion 26 pivotally coupled to first upright member 17, as shown in FIG. 7. In the extended configuration, first portion 24 and second portion 26 are coupled such that corresponding first upright member 17 is coterminous with first portion 24 and second portion 26 to provide a flush top upright member end portion providing an aesthetically pleasing connector assembly as well as preventing undesirable contact with the user. Second connector assemblies 18 define a first lateral edge of collapsible frame 10 and third connector assemblies 20 define an opposing second lateral edge of collapsible frame 10.

Figure 4:
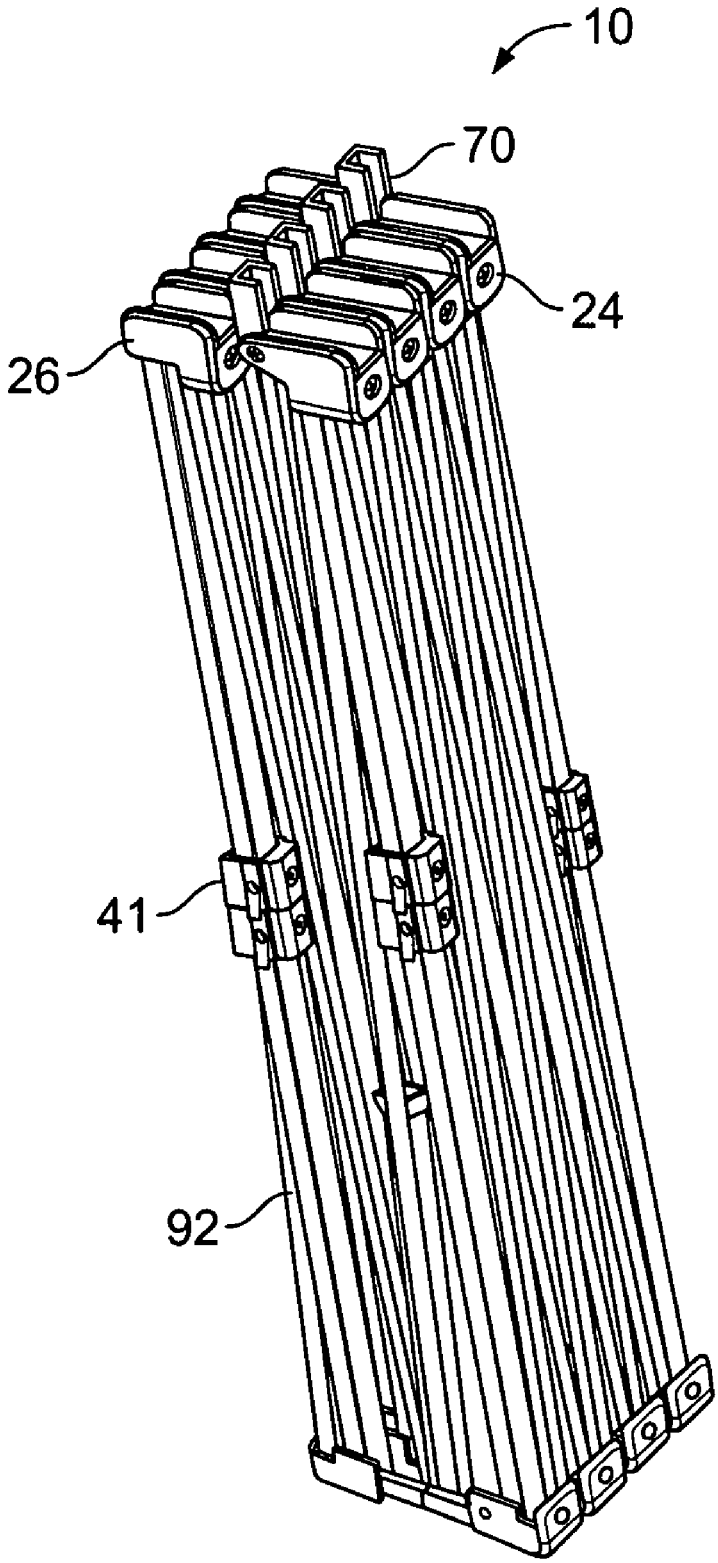
FIG. 4 is a perspective view of the collapsible frame shown in FIG. 1 in a collapsed configuration.

A substantially planar support structure 30 is formed between first connector assemblies 16 and second connector assemblies 18 and between first connector assemblies 16 and third connector assemblies 20. Substantially planar support structure 30 is configured to support mattress 12. More specifically, substantially planar support structure 30 includes at least one foldable cross-support unit 32. In one embodiment, a plurality of cross-support units 32 are movable between an extended configuration, as shown in FIG. 1, to define substantially planar support structure 30, and a folded configuration, as shown in FIG. 3. Further, cross-support units 32 are pivotally movable with respect to upright members 17 between the folded configuration and a collapsed configuration, as shown in FIG. 4, to facilitate storing and/or transporting frame 10. Each cross-support unit 32 is coupled between a plurality of connector assemblies. For example, referring further to FIG. 1, a first cross-support unit 32 is coupled between a plurality of first connector assemblies 16 and a plurality of second connector assemblies 18. Similarly, a second cross-support unit 32 is coupled between a plurality of first connector assemblies 16 and a plurality of third connector assemblies 20.

Cross-support unit 32 includes a first member 34 and a second member 36 coupled together. Each first member 34 and second member 36 has a first end 37, a second end 38 and an intermediate point 40 therebetween. First member 34 is pivotally coupled to second member 36 at a respective intermediate point 40. First member 34 is coupled to a corresponding first connector assembly 16 at first end 37 and to a corresponding second connector assembly 18 at second end 38. Similarly, second member 36 is coupled to a corresponding first connector assembly 16 at first end 37 and to a corresponding second connector assembly 18 at second end 38. Each first member 34 and each second member 36 are coupled to first portion 24 of a corresponding first connector assembly 16 such that cross-support unit 32 is pivotally movable with respect to first upright members 17 about longitudinal axis 22. More specifically, with cross-support unit 32 in the folded configuration, each first member 34 and each second member 36 is pivotally movable with respect to a corresponding first upright member 17 about longitudinal axis 22 to move frame 10 towards the collapsed configuration.

Similarly, the second cross-support unit 32 includes first member 34 and second member 36 coupled together at intermediate point 40. First member 34 is coupled to a corresponding first connector assembly 16 at first end 37 and to a corresponding third connector assembly 20 at second end 38. Similarly, second member 36 is coupled to a corresponding first connector assembly 16 at first end 37 and to a corresponding third connector assembly 20 at second end 38. Each first member 34 and each second member 36 are coupled to second portion 26 of a corresponding first connector assembly 16 such that cross-support unit 32 is pivotally movable with respect to first upright members 17 about longitudinal axis 22. More specifically, with cross-support unit 32 in the folded configuration, each first member 34 and each second member 36 is pivotally movable with respect to a corresponding first upright member 17.

In one embodiment, at least one extendible support member 41 is positioned between adjacent laterally aligned connector assemblies. For example, as shown in FIG. 1, at least one extendible support member 41 is coupled between a first connector assembly 16 and a corresponding second connector assembly 18. Similarly, at least one extendible support member 41 may be coupled between a first connector assembly 16 and a corresponding third connector assembly 20.

As shown in FIGS. 5 and 6, extendible support member 41 includes members that are movable with respect to each other to extend and retract extendible support member 41, such as a telescopic assembly 42. In one embodiment, telescopic assembly 42 includes a first or outer member 44 and a sleeve 46 coupled to an end portion of outer member 44. Sleeve 46 defines a sliding slot 48 communicating with an aperture 49. A second or inner member 50 is slidably coupled within outer member 44 and a locking device 52 fixedly couples outer member 44 and inner member 50. Locking device 52 includes a spring bracket 54 positioned within inner member 50. In one embodiment, spring bracket 54 is coupled to an inner surface of inner member 50 using a suitable fastener, such as a screw or rivet, and/or a weld to retain spring bracket 54 properly positioned within inner member 50. In alternative embodiments, other suitable mechanisms may be used to retain spring bracket 54 properly positioned within inner member 50.

Referring further to FIG. 6, spring bracket 54 includes a first end 55, a second end 56 generally opposing first end 55 and a bend portion 57 between first end 55 and second end 56. Spring bracket 54 includes a first locking projection 58 at first end 55 that is configured to extend through a first opening 59 defined within inner member 50 under application of a suitable force and a second locking projection 60 between first end 55 and bend portion 57 that is configured to extend through a second opening 62 defined within inner member 50 under application of a suitable force. Bend portion 57 is configured to apply a force that urges first end 55 to diverge from second end 56. This divergent force is sufficient to urge first locking projection 58 and second locking projection 60 into respective openings 59 and 62 with inner member 50 aligned with outer member 44. First locking projection 58 is movably positioned within sliding slot 48 defined within sleeve 46 such that first locking projection 58 extends into aperture 49 to lock outer member 44 with respect to inner member 50. To unlock locking device 52, a suitable force is applied to first locking projection 58 such that first end 55 of spring bracket 54 is moved inwardly with respect to inner member 50 toward second end 56. As first end 55 moves inwardly, first locking projection 58 is released from aperture 49 and from within sliding slot 48 to allow outer member 44 to move with respect to inner member 50.

Referring again to FIG. 4, in one embodiment, each first connector assembly 16 is pivotally coupled to a corresponding first upright member 17. In a particular embodiment, first upright member 17 forms a slide groove 70 or other suitable void. A cooperating pivot extends at least partially into slide groove 70 to facilitate properly positioning first connector assembly 16 with respect to first upright member 17.

As shown in FIG. 7, first portion 24 and second portion 26 of first connector assembly 16 are frictionally fitted together to facilitate coupling first portion 24 to second portion 26. In one embodiment, first portion 24 includes a projection 80 and second portion 26 defines a cooperating void (not shown in FIG. 6) within which projection 80 is positioned to coupled first portion 24 to second portion 26.

In a further embodiment, frame 10 includes additional support members, such as a first frame member 90 and/or a second frame member 92. As shown in FIG. 1, first frame member 90 extends between and is pivotally coupled to first portion 24 of first connector assembly 16 and a laterally aligned second upright member 19. Second frame member 92 extends between and is pivotally coupled to second portion 26 of first connector assembly 16 and a laterally aligned third upright member 21. First frame members 90 and second frame members 92 facilitate moving the associated upright members as cross-support unit 32 is moved between the folded configuration and the expanded configuration to facilitate easy construction or collapsing of frame 10, as desired.

More specifically, as cross-support unit 32 is moved from the folded configuration to the expanded configuration, extendible support member 41 coupled between first portion 24 of first connector assembly 16 and a corresponding second connector assembly 18 moves from the extended configuration to the retracted configuration and second upright members 19, coupled via first frame member 90 to first portion 24, pivot outwardly with respect to cross-support unit 32. With cross-support unit 32 in the expanded configuration, second upright members 19 are substantially perpendicular to cross-support unit 32. As cross-support unit 32 is moved from the expanded configuration to the folded configuration, extendible support member 41 moves from the retracted configuration to the extended configuration and second upright members 19 pivot inwardly towards cross-support unit 32. In one embodiment, movement of extendible support member 41 facilitates urging second upright members 19 to pivot. With cross-support unit 32 in the folded configuration, second upright members 19 are substantially parallel to cross-support unit 32. Further, with cross-support unit 32 in the folded configuration, cross-support unit 32 is pivotally movable with respect to first upright members 17 to facilitate moving frame 10 towards the collapsed configuration. More specifically, cross-support unit 32 pivots with respect to first upright member 17 through first portion 24 of first connector assembly 16 pivotally coupled to first upright member 17.

Similarly, as a laterally opposing second cross-support unit 32 is moved from the folded configuration to the expanded configuration, a second extendible support member 41 coupled between second portion 26 of first connector assembly 16 and a corresponding third connector assembly 20 moves from the extended configuration to the retracted configuration and third upright members 21, coupled via second frame member 92 to second portion 26, pivot outwardly with respect to second cross-support unit 32. In one embodiment, movement of extendible support member 41 facilitates urging third upright members 21 to pivot. With second cross-support unit 32 in the expanded configuration, third upright members 21 are substantially perpendicular to second cross-support unit 32. As second cross-support unit 32 is moved from the expanded configuration to the folded configuration, second extendible support member 41 moves from the retracted configuration to the extended configuration and third upright members 21 pivot inwardly towards second cross-support unit 32. With second cross-support unit 32 in the folded configuration, third upright members 21 are substantially parallel to second cross-support unit 32. Further, with second cross-support unit 32 in the folded configuration, second cross-support unit 32 is pivotally movable with respect to first upright members 17 to facilitate moving frame 10 towards the collapsed configuration. More specifically, second cross-support unit 32 pivots with respect to first upright member 17 through second portion 26 of first connector assembly 16 pivotally coupled to first upright member 17.

Referring to FIGS. 8-11, bed 100 includes collapsible frame 10 and mattress 12, including in one embodiment an air mattress assembly 102, removably coupled to frame 10. In a particular embodiment, air mattress assembly 102 includes a covering 104 and a fabric skirt 106. A plurality of fasteners 110, such as a fastener having a L-shape, are coupled to a bottom surface 112 (shown in FIG. 11) of covering 104. Covering 104 defines a compartment 114 configured to receive an air mattress 116. Compartment 114 is opened or closed, as desired, using a suitable fastener component, such as a zipper. In one embodiment, fasteners 110 are generally aligned in rows. Each fastener 110 includes a projection 120 that is removably inserted into a recess formed on corresponding first connector assembly 16, second connector assembly 18 or third connector assembly 20.

In an alternative embodiment, as shown in FIGS. 12-20, an alternative exemplary collapsible frame 130 is provided that includes components that are similar to like components of collapsible frame 10, unless otherwise described below. Thus, identical element reference numbers are used to describe components of collapsible frame 130 that are similar to like components of collapsible frame 10 described above. Collapsible frame 130 includes at least one extendible support member 141 having members that are movable with respect to each other to extend and retract extendible support member 141, such as a telescopic assembly 142. In one embodiment, telescopic assembly 142 includes a first or outer member 144 that defines a first opening 146 and a flexible member 148. A second or inner member 150 is slidably coupled within outer member 144 and defines a second opening 152 that can be aligned with first opening 146. A spring bracket 160 is positioned within inner member 150. Spring bracket 160 includes a locking projection 162 that is positionable within second opening 152 and first opening 146. Flexible member 148 is integrated with or coupled to outer member 144 and forms a projection, such as a boss 180 shown in FIG. 18, which is configured to be positioned within first opening 146. In one embodiment, boss 180 has a size and shape configured to extend at least partially within first opening 146. To unlock outer member 144 from inner member 150, a suitable force is applied to flexible member 148 such that boss 180 extends into first opening 146 to urge spring bracket 160 inwardly with respect to inner member 150. As spring bracket 160 moves inwardly, locking projection 162 is pushed inwardly through first opening 146 and is released from within first opening 146 to allow outer member 144 to move with respect to inner member 150.

Figure 19:
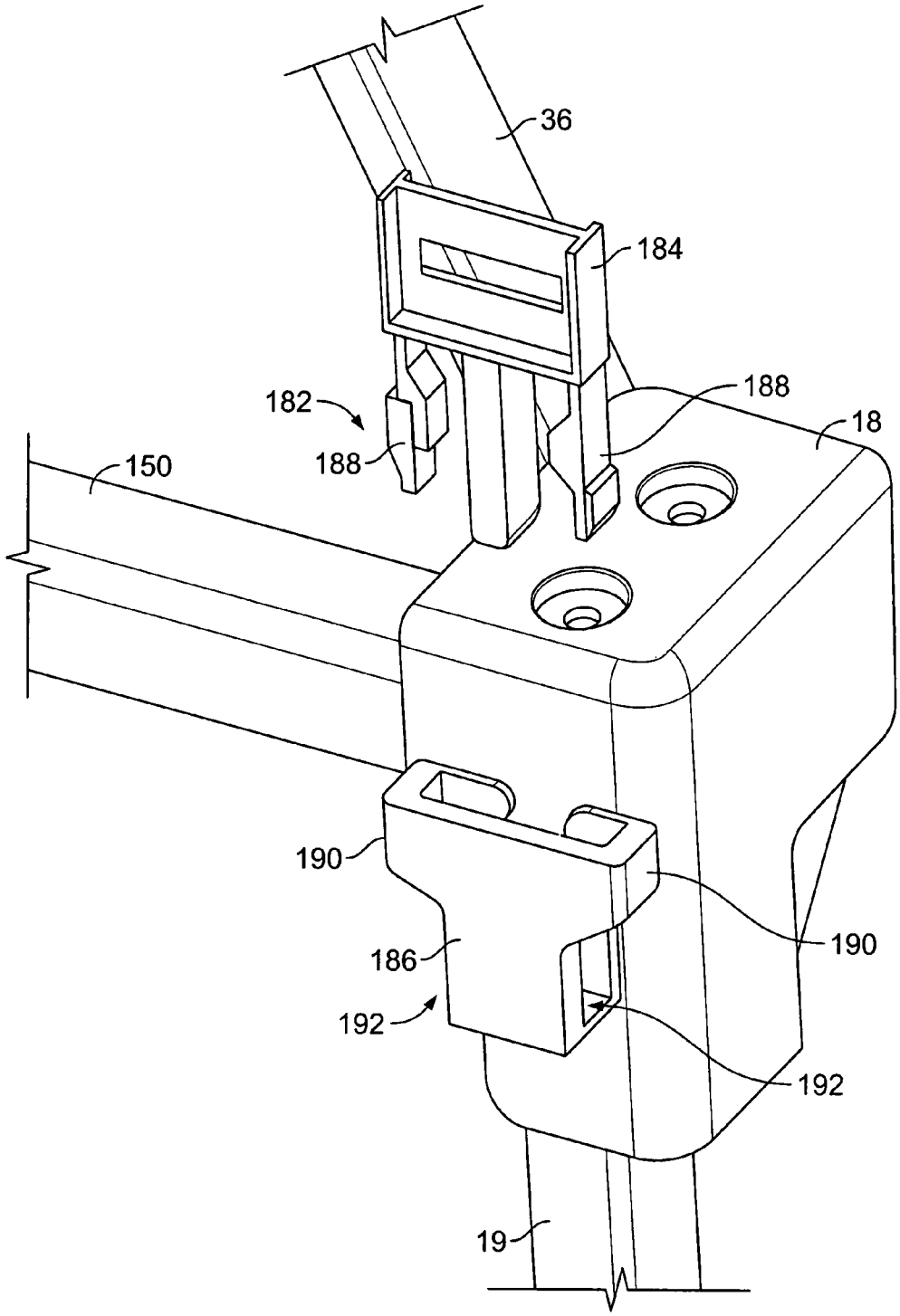
FIG. 19 is an enlarged view of a portion of the collapsible frame shown in FIG. 12.
Figure 20:
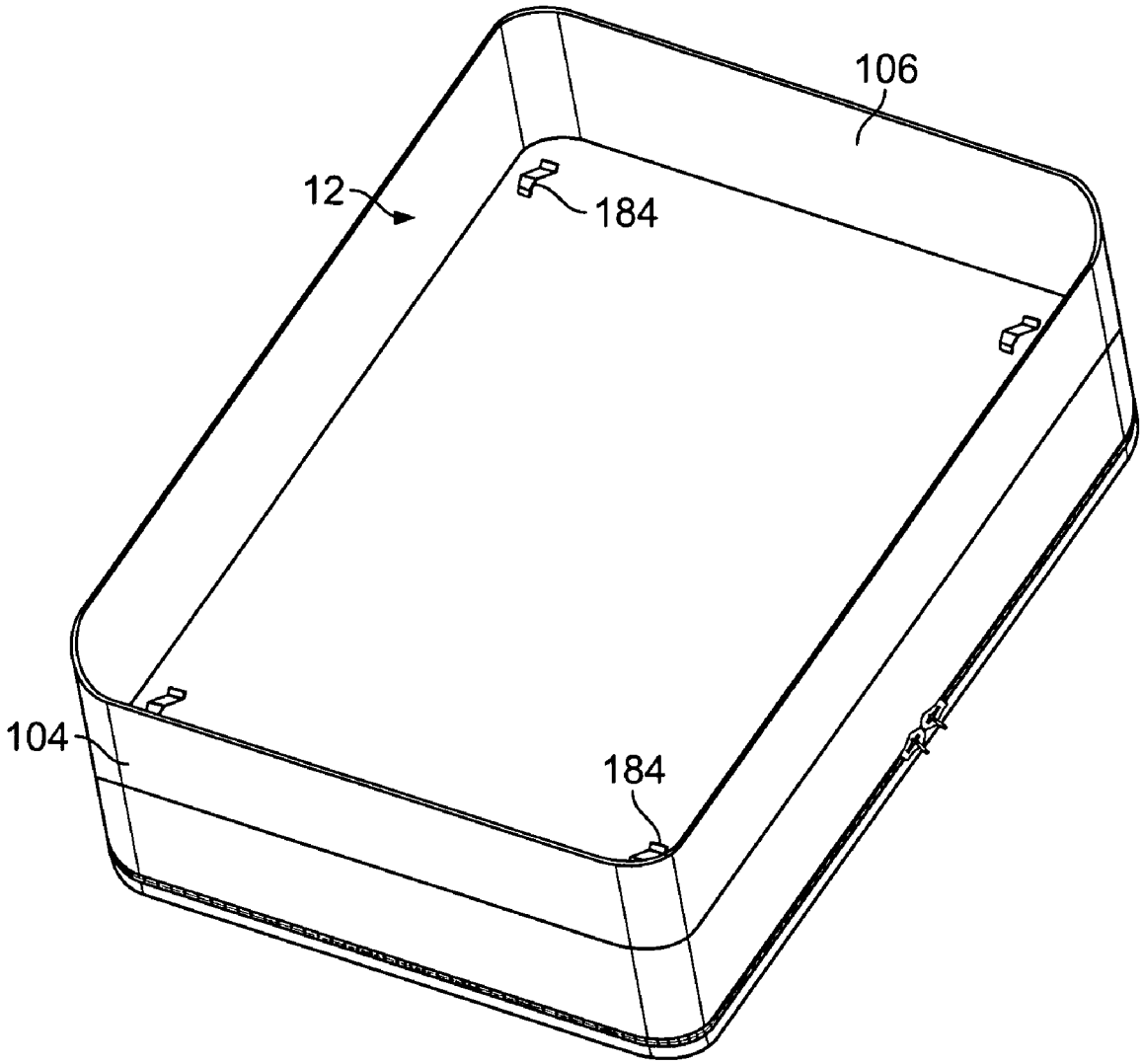
FIG. 20 is a perspective view of a bottom surface of an air mattress assembly suitable for use with the collapsible frame shown in FIG. 12.

Referring to FIGS. 19 and 20, in a further alternative embodiment, bed 100 includes a buckle arrangement 182 including a buckle 184 configured to releasably engage a socket 186. In one embodiment, buckle 184 is configured to snap-fit within socket 186. Air mattress assembly 102 includes a plurality of buckles 184 in addition to or in lieu of fasteners 110. In a particular embodiment, buckles 184 are coupled to bottom surface 112 of covering 104. Each buckle 184 facilitates coupling one of the four corners of covering 104 to frame 10. More specifically, each buckle 184 is releasably engaged with a corresponding socket 186 formed within or coupled to a respective connector assembly, such as second connector assembly 18 or third connector assembly 20, as shown in FIG. 19. A suitable force is applied to buckle 184 such that tabs 188 move from an initial position laterally inwardly as buckle 184 slidably engages edge portions 190 of socket 186 at least partially defining a corresponding void 192. As tab 188 is slidably positioned within corresponding void 192, tab 188 moves laterally outwardly towards the initial position. In the initial position, tab 188 facilitates retaining buckle 184 engaged with socket 186. To release buckle 184 from within socket 186, a suitable force is applied to tabs 188 to urge tabs laterally inwardly such that buckle 184 can be slidably removed from within socket 186.

In one embodiment, a method for constructing or making a bed having a collapsible frame is provided. The frame includes a plurality of connector assemblies and a cross-support unit coupled between the plurality of connector assemblies. In a particular embodiment, at least one connector assembly of the plurality of connector assemblies moves parallel to a longitudinal axis of the frame as the frame moves from a folded configuration to an expanded configuration. The cross-support unit is moved between the folded configuration and the expanded configuration to define a substantially planar support structure in the expanded configuration suitable for supporting a mattress.

In one embodiment, the frame includes a plurality of first connector assemblies, a plurality of second connector assemblies, and a cross-support unit coupled between the plurality of first connector assemblies and the plurality of second connector assemblies such that the plurality of first connector assemblies move along a longitudinal axis of the frame as the frame moves from a folded configuration to an expanded configuration. The cross-support unit is moved between the folded configuration and the expanded configuration to define the substantially planar support structure in the expanded configuration. As the cross-support unit is moved from the folded configuration to the expanded configuration, a distance between adjacent first connector assemblies is increased. In a particular embodiment, each first connector assembly includes a first portion and a cooperating second portion. As the cross-support unit is moved, the first portion is coupled to the second portion to facilitate retaining the collapsible frame in the expanded configuration. In a further embodiment, a projection formed on or coupled to the first portion is positioned within a slot defined within the second portion. With the frame in the expanded configuration, a mattress is positioned on the substantially planar support structure.

In a particular embodiment, an extendible support member is coupled between one first connector assembly and a corresponding laterally aligned second connector assembly or laterally aligned third connector assembly. As the cross-support unit is moved, the extendible support member also moves from an extended configuration and a retracted configuration. The extendible support member can be locked in the desired configuration.

Further, the cross-support unit is pivotally movable with respect to a plurality of first upright members each coupled to a corresponding first connector assembly to facilitate moving the frame between the folded configuration and a collapsed configuration for storing and/or transporting the frame. A plurality of second upright members are pivotally coupled to a corresponding first member or corresponding second member of the cross-support unit. Each second upright member is pivotally moved with respect to the corresponding first member or second member to facilitate moving the frame to the collapsed configuration.

The above-described bed and collapsible frame facilitate providing a sleeping area quickly and efficiently. More specifically, the collapsible frame is movable between a collapsed configuration, facilitating storage and/or transportation of the bed, and an expanded configuration defining a substantially planar support structure configured to support a mattress.

Exemplary embodiments of a collapsible frame and method of constructing or making a bed are described above in detail. The apparatus and method are not limited to the specific embodiments described herein, but rather, components of the apparatus and/or steps of the method may be utilized independently and separately from other components and/or steps described herein. Further, the described apparatus components and/or method steps can also be defined in, or used in combination with, other apparatus and/or methods, and are not limited to practice with only the apparatus and method as described herein.

While the invention has been described in terms of various specific embodiments, those skilled in the art will recognize that the invention can be practiced with modification within the spirit and scope of the claims.

What is claimed is:

1. A frame comprising:

a plurality of connector assemblies; and a plurality of upright members, each of said plurality of upright members pivotally coupled to at least one of said plurality of connector assemblies; and a cross-support unit coupled between said plurality of connector assemblies, said cross-support unit movable between a folded configuration and an expanded configuration by way of said plurality of connector assemblies, said cross-support unit defining a substantially horizontal planar support structure in the expanded configuration, at least one of said plurality of connector assemblies coupled to one of said plurality of upright members is positioned along a longitudinal axis of said frame, wherein said cross-support unit further comprises a first member and a second member each having a first end, a second end, and an intermediate point therebetween, said first member pivotally coupled to said second member at said intermediate point, wherein said first member is coupled to one first connector assembly of said plurality of connector assemblies at said first end and to one second connector assembly of said plurality of connector assemblies at said second end.

2. A frame in accordance with claim 1 wherein said cross-support unit is movable between the folded configuration and the extended configuration such that at least one connector assembly of said plurality of connector assemblies moves parallel to said longitudinal axis of said frame.

3. A frame comprising:

a plurality of upright members;

a plurality of first connector assemblies, each of said plurality of first connector assemblies being pivotally coupled to a corresponding one of said plurality of upright members;

a plurality of second connector assemblies;

a plurality of third connector assemblies;

a first cross-support unit coupled between said plurality of first connector assemblies and said plurality of second connector assemblies, said first cross-support unit movable between a folded configuration and an expanded configuration by way of the plurality of first connector assemblies and said plurality of second connector assemblies, said first cross-support unit defining a substantially horizontal planar support structure in the expanded configuration, said plurality of first connector assemblies positioned along a longitudinal axis of said frame; and a second cross-support unit coupled between said plurality of first connector assemblies and said plurality of third connector assemblies, said second cross-support unit movable between a folded configuration and an expanded configuration by way of the plurality of first connector assemblies and said plurality of third connector assemblies, said second cross-support unit defining a substantially horizontal planar support structure in the expanded configuration;

wherein each of said first cross-support unit and said second cross-support unit further comprises a first member and a second member each having a first end, a second end, and an intermediate point therebetween, said first member pivotally coupled to said second member at said intermediate point; and wherein said first member is coupled to one first connector assembly of said plurality of first connector assemblies at said first end and to one of one second connector assembly of said plurality of second connector assemblies and to one third connector assembly of said plurality of said third connector assemblies at said second end.

4. A frame in accordance with claim 3 wherein each said first member and each said second member pivotally is coupled at said first end to a corresponding said upright member.

5. A frame in accordance with claim 4 wherein, with said first cross-support unit and/or said second cross-support unit in the folded configuration, each corresponding first member and each corresponding second member is pivotally movable with respect to the corresponding said upright member.

6. A frame in accordance with claim 3 wherein a distance between adjacent said first connector assemblies increasing as said first cross-support unit and said second cross-support unite move from the folded configuration to the expanded configuration.

7. A frame in accordance with claim 6 wherein, with said first cross-support unit and/or said second cross-support unit in the folded configuration, said first cross-support unit and/or said second cross-support unit in the folded configuration is pivotally movable about said longitudinal axis with respect to said plurality of upright members.

8. A frame in accordance with claim 3 wherein a first distance between adjacent said first connector assemblies with said cross-support unit in the expanded configuration is greater than a second distance between adjacent said first connector assemblies with said cross-support unit in the folded configuration.

9. A frame in accordance with claim 3 wherein each said first connector assembly contacts an adjacent said first connector assembly with said first cross-support unit and said second cross-support unit in the folded configuration.

10. A frame comprising:

a plurality of connector assemblies;

a cross-support unit coupled between said plurality of connector assemblies, said cross-support unit movable between a folded configuration and an expanded configuration by way of a plurality of first connector assemblies; and an extendible support member coupled between a first connector assembly of said plurality of connector assemblies and a laterally aligned second connector assembly of said plurality of connector assemblies, said extendible support member movable between a retracted configuration and an extended configuration.

11. A frame in accordance with claim 10 further comprising a locking device configured to selectively retain said extendible support member in one of the retracted configuration and the extended configuration.

12. A frame in accordance with claim 10 wherein said extendible support member further comprises a first member and a second member slidably coupled within said first member.

13. A frame in accordance with claim 12 further comprising a locking device configured to selectively lock said first member with respect to said second member.

14. A frame in accordance with claim 13 where said locking device further comprises a spring bracket positioned within said second member, said spring bracket further comprising a first projection positionable within an aperture defined within said first member to facilitate locking said first member with respect to said second member.

15. A frame comprising:

a plurality of upright members;

a first connector assembly having a first portion and a second portion movably coupled to said first portion to facilitate moving said frame between a collapsed configuration and an expanded configuration, said first connector assembly being pivotally coupled to a corresponding one of said plurality of upright members;

a second connector assembly laterally aligned with said first connector assembly;

a third connector assembly;

a first cross-support unit coupled between said first connector assembly and said second connector assembly, said cross-support unit defining a substantially horizontal planar support structure in said expanded configuration, said first connector assembly positioned along a longitudinal axis of said frame;

a second cross-support unit coupled between said first connector assembly and said third connector assembly, said second cross-support unit movable between a folded configuration and an expanded configuration by way of said first connector assembly and said third connector assembly, said second cross-support unit defining a substantially horizontal planar support structure in the expanded configuration;

wherein each of said first cross-support unit and said second cross-support unit further comprises a first member and a second member each having a first end, a second end, and an intermediate point therebetween, said first member pivotally coupled to said second member at said intermediate point; and wherein said first member is coupled to said first connector assembly at said first end and to one of said second connector assembly and said third connector assembly at said second end.

16. A frame in accordance with claim 15 wherein said first portion further comprises a projection and said second portion further defines a slot, said projection positioned within said slot to facilitate coupling said first portion to said second portion.

17. A frame in accordance with claim 15 wherein said first portion and said second portion are pivotally coupled to said corresponding one of said upright members.

18. A frame in accordance with claim 15 wherein one of said plurality of upright members is pivotally coupled to said second connector assembly.

19. A frame comprising:

a plurality of first connector assemblies;

a plurality of second connector assemblies, each second connector assembly of said plurality of second connector assemblies laterally aligned with a corresponding first connector assembly of said plurality of first connector assemblies;

a plurality of third connector assemblies;

a plurality of first upright members, each first upright member of said plurality of first upright members pivotally coupled to a corresponding said first connector assembly;

a plurality of second upright members, each second upright member of said plurality of second upright members pivotally coupled to a corresponding said second connector assembly;

a plurality of third upright members, each third upright member of said plurality of third upright members pivotally coupled to a corresponding said third connector assembly;

a first cross-support unit coupled between said plurality of first connector assemblies and said plurality of second connector assemblies, said first cross-support unit movable between a folded configuration and an expanded configuration by way of the plurality of first connector assemblies and said plurality of second connector assemblies, said first cross-support unit defining a substantially horizontal planar support structure in the expanded configuration, said plurality of first connector assemblies positioned along a longitudinal axis of said frame; and a second cross-support unit coupled between said plurality of first connector assemblies and said plurality of third connector assemblies, said second cross-support unit movable between a folded configuration and an expanded configuration by way of the plurality of first connector assemblies and said plurality of third connector assemblies, said second cross-support unit defining a substantially horizontal planar support structure in the expanded configuration.

20. A frame in accordance with claim 19 wherein each said second upright member is pivotally movable with respect to said cross-support unit.

21. A frame in accordance with claim 19 wherein, with said cross-support unit in the expanded configuration, said cross-support unit is substantially perpendicular to said plurality of first upright members and said plurality of second upright members.

22. A frame in accordance with claim 19 further comprising a frame member coupled between a first connector assembly of said plurality of first connector assemblies and a laterally aligned second upright member of said plurality of second upright members to facilitate pivotally moving said second upright member with respect to said cross-support unit as said cross-support unit is moved between the folded configuration and the expanded configuration.

23. A frame in accordance with claim 19 further comprising a frame member coupled between a first connector assembly of said plurality of first connector assemblies and a laterally aligned second upright member of said plurality of second upright members to facilitate moving said second upright member as said frame is moved between a collapsed configuration and an expanded configuration.

24. A frame comprising:

a plurality of upright members;

a plurality of first connector assemblies positioned along a longitudinal axis of said frame, each of said plurality of first connector assemblies being pivotally coupled to a corresponding one of said plurality of upright members;

a plurality of second connector assemblies, each of said plurality of second connector assemblies being pivotally coupled to a corresponding one of said plurality of upright members;

a plurality of third connector assemblies, each third connector assembly of said plurality of third connector assemblies being pivotally coupled to a corresponding one of said plurality of upright members;

a first cross-support unit coupled between said plurality of first connector assemblies and said plurality of second connector assemblies, said first cross-support unit movable between a folded configuration and an expanded configuration by way of said plurality of first connector assemblies and said plurality of second connector assemblies such that at least one first connector assembly of said plurality of first connector assemblies moves along said longitudinal axis, said first cross-support unit defining a substantially horizontal planar support structure in the expanded configuration, wherein said first cross-support unit is pivotally movable with respect to said plurality of upright members with said first cross-support unit in the folded configuration; and a second cross-support unit coupled between said plurality of first connector assemblies and said plurality of third connector assemblies, said second cross-support unit movable between a folded configuration and an expanded configuration by way of the plurality of first connector assemblies and said plurality of third connector assemblies, said second cross-support unit defining a substantially horizontal planar support structure in the expanded configuration.

25. A frame in accordance with claim 24 wherein each of said plurality of first connector assemblies is laterally aligned with a corresponding second connector assembly of said plurality of second connector assemblies and a corresponding third connector assembly of said plurality of said third connector assemblies.

26. A bed comprising:

a frame comprising a plurality of connector assemblies, a plurality of upright members pivotally coupled to at least one of said plurality of connector assemblies, a cross-support unit coupled between said plurality of connector assemblies, said cross-support unit movable between a folded configuration and an expanded configuration by way of said plurality of connector assemblies, said cross-support unit defining a substantially horizontal planar support structure in the expanded configuration, at least one of said plurality of connector assemblies coupled to one of said plurality of upright members is positioned along a longitudinal axis of said frame, wherein said cross-support unit further comprises a first member and a second member each having a first end, a second end, and an intermediate point therebetween, said first member pivotally coupled to said second member at said intermediate point, wherein said first member is coupled to one first connector assembly of said plurality of connector assemblies at said first end and to one second connector assembly of said plurality of connector assemblies at said second end; and a mattress coupled to said frame.

27. A bed in accordance with claim 26 further comprising:

a plurality of sockets coupled to a corresponding connector assembly of said plurality of connector assemblies;

a covering configured to receive said mattress; and a plurality of buckles coupled to said covering, each buckle of said plurality of buckles engaged with a corresponding socket of said plurality of sockets to facilitate coupling said mattress to said collapsible frame.

28. A bed comprising:

a collapsible frame comprising:

a plurality of upright members;

a plurality of first connector assemblies, each of said plurality of first connector assemblies being pivotally coupled to a corresponding one of said plurality of upright members;

a plurality of second connector assemblies;

a plurality of third connector assemblies;

a first cross-support unit coupled between said plurality of first connector assemblies and said plurality of second connector assemblies, said first cross-support unit movable between a folded configuration and an expanded configuration by way of said plurality of first connector assemblies and said plurality of second connector assemblies, said first cross-support unit defining a substantially horizontal planar support structure in the expanded configuration, said plurality of first connector assemblies positioned along a longitudinal axis of said frame;

a second cross-support unit coupled between said plurality of first connector assemblies and said plurality of third connector assemblies, said second cross-support unit movable between a folded configuration and an expanded configuration by way of the plurality of first connector assemblies and said plurality of third connector assemblies, said second cross-support unit defining a substantially horizontal planar support structure in the expanded configuration;

a mattress coupled to said collapsible frame; and a covering configured to receive said mattress, and a plurality of buckles coupled to said covering and engaged with a corresponding socket formed in one of a corresponding said first connector assembly and said second connector assembly to facilitate coupling said mattress to said collapsible frame.

29. A method for constructing a bed having a collapsible frame, said method comprising:

providing a frame comprising a plurality of connector assemblies, a plurality of upright members pivotally coupled to at least one of the plurality of connector assemblies, and a cross-support unit coupled between the plurality of connector assemblies, at least one of the plurality of connector assemblies coupled to one of the plurality of upright members is positioned along a longitudinal axis of the frame;

moving the cross-support unit between a folded configuration and an expanded configuration by way of the plurality of connector assemblies to define a substantially horizontal planar support structure in the expanded configuration; and pivotally moving the cross-support unit with respect to the plurality of upright members.

30. A method for constructing a bed having a collapsible frame, said method comprising:

providing a frame comprising a plurality of first connector assemblies, a plurality of upright members pivotally coupled to the plurality of first connector assemblies, a plurality of second connector assemblies, and a cross-support unit coupled between the plurality of first connector assemblies and the plurality of second connector assemblies such that the plurality of first connector assemblies move along a longitudinal axis of the frame as the frame moves from a folded configuration to an expanded configuration;

moving the cross-support unit between the folded configuration and the expanded configuration by way of the plurality of first connector assemblies and the plurality of second connector assemblies to define a substantially horizontal planar support structure in the expanded configuration; and pivotally moving with respect to the cross-support unit a plurality of second upright members each coupled to a corresponding second connector assembly of said plurality of second connector assemblies.

31. A method in accordance with claim 30 further comprising maintaining in a static position each of said plurality of upright members coupled to a corresponding one of said plurality of first connector assemblies as the plurality of second upright members pivotally move.

32. A method in accordance with claim 30 further comprising positioning a mattress on the substantially planar support structure.

33. A method in accordance with claim 30 wherein, with the plurality of first connector assemblies aligned along the longitudinal axis, moving the cross-support unit further comprises increasing a distance between adjacent first connector assemblies as the cross-support unit moves towards the expanded configuration.

34. A method in accordance with claim 30 wherein the frame further comprising an extendible support member coupled between a first connector assembly and a corresponding laterally aligned second connector assembly, moving the cross-support unit further comprises moving the extendible support member between an extended configuration and a retracted configuration.

35. A method in accordance with claim 34 further comprising locking the extendible support member in one of the extended configuration and the retracted configuration.

36. A method in accordance with claim 30 wherein each of the plurality of first connector assemblies further comprises a first portion and a second portion, moving the cross-support unit further comprises coupling the first portion to the second portion to facilitate retaining the collapsible frame in the expanded configuration.

37. A method in accordance with claim 36 further comprising positioning a projection formed on the first portion within a slot defined within the second portion.

38. A frame comprising:

a plurality of connector assemblies;

a cross-support unit coupled between said plurality of connector assemblies, said cross-support unit movable between a folded configuration and an expanded configuration by way of said plurality of connector assemblies, wherein said cross-support unit comprises a first member and a second member each having a first end, a second end, and an intermediate point therebetween, said first member pivotally coupled to said second member at said intermediate point, wherein said first member is coupled to one first connector assembly of said plurality of connector assemblies at said first end and to one second connector assembly of said plurality of connector assemblies at said second end;

a plurality of first upright members, each upright member of said plurality of first upright members coupled to a corresponding said connector assembly;

a plurality of second upright members; and a plurality of frame members, each of said plurality of frame members coupled between a corresponding first upright member of said plurality of first upright members and a laterally aligned second upright member of said plurality of second upright members to facilitate pivotally moving said second upright member with respect to said cross-support unit.

* * * * *